US010015853B2

(12) United States Patent
Yoo et al.

(10) Patent No.: US 10,015,853 B2
(45) Date of Patent: Jul. 3, 2018

(54) LED LIGHTING DEVICE USING AC POWER SUPPLY

(71) Applicant: LUMENS CO., LTD., Yongin-si, Gyeonggi-do (KR)

(72) Inventors: Soo Geun Yoo, Seoul (KR); Hong Geol Choi, Suwon-si (KR); Ho Young Lee, Seongnam-si (KR); Myeong Kook Gong, Yongin-si (KR)

(73) Assignee: LUMENS CO., LTD., Yongin-si (KR)

( * ) Notice: Subject to any disclaimer, the term of this patent is extended or adjusted under 35 U.S.C. 154(b) by 0 days.

(21) Appl. No.: 15/687,491

(22) Filed: Aug. 27, 2017

(65) Prior Publication Data

US 2017/0354001 A1 Dec. 7, 2017

Related U.S. Application Data

(63) Continuation of application No. 15/356,636, filed on Nov. 20, 2016, now Pat. No. 9,788,377, which is a (Continued)

(30) Foreign Application Priority Data

May 21, 2014 (KR) ..... 10-2014-0061077
Oct. 30, 2014 (KR) ..... 10-2014-0149071
Nov. 18, 2014 (KR) ..... 10-2014-0160628

(51) Int. Cl.
*H05B 37/02* (2006.01)
*H05B 33/08* (2006.01)

(52) U.S. Cl.
CPC ..... *H05B 33/083* (2013.01); *H05B 33/0815* (2013.01); *H05B 33/0845* (2013.01); *H05B 37/02* (2013.01)

(58) Field of Classification Search
CPC ..... H05B 33/0815; H05B 33/083; H05B 33/0845
(Continued)

(56) References Cited

U.S. PATENT DOCUMENTS 8,081,722 B1 12/2011 Furman
8,384,311 B2 2/2013 Gray
(Continued)

FOREIGN PATENT DOCUMENTS

DE 102012207456 A 11/2013
EP 2 533 307 A 12/2012
(Continued)

OTHER PUBLICATIONS

Office Action dated Apr. 27, 2016, in Korean Patent Application No. KR 10-2014-0160628, 5 pgs.
(Continued)

*Primary Examiner* — Tung X Le
(74) *Attorney, Agent, or Firm* — Mei & Mark LLP

(57) ABSTRACT

Provided is a light emission device. When the size of an input voltage exceeds a minimum light emission voltage, all light emission elements emit light always irrespective of the size of a voltage, and as the size of the voltage decreases, the light emission device has a configuration in which the light emission elements are connected in parallel with each other, and as the size of the voltage increases, the light emission device has a configuration in which the light emission elements are connected in series with each other.

20 Claims, 28 Drawing Sheets

Related U.S. Application Data continuation of application No. 14/763,668, filed as application No. PCT/KR2015/000318 on Jan. 13, 2015, now Pat. No. 9,572,212.

(58) Field of Classification Search
USPC ..... 315/185 R, 193, 294
See application file for complete search history.

(56) References Cited

U.S. PATENT DOCUMENTS

| | | | | |
|---|---|---|---|---|
| 8,598,796 | B2 | 12/2013 | Jeong | |
| 8,686,651 | B2 | 4/2014 | Lynch | |
| 8,901,835 | B2 * | 12/2014 | Kang | H05B 33/0809 315/193 |
| 8,901,849 | B2 | 12/2014 | Jeong | |
| 9,307,612 | B2 | 4/2016 | Jao | |
| 9,357,605 | B2 | 5/2016 | Jung | |
| 2007/0257623 | A1 | 11/2007 | Johnson | |
| 2009/0224689 | A1 | 9/2009 | Yang | |
| 2010/0164403 | A1 | 7/2010 | Liu | |
| 2010/0194298 | A1 | 8/2010 | Kuwabara | |
| 2010/0308739 | A1 * | 12/2010 | Shteynberg | H05B 33/083 315/193 |
| 2011/0199003 | A1 | 8/2011 | Muguruma et al. | |
| 2012/0104952 | A1 * | 5/2012 | Chen | H05B 33/083 315/122 |
| 2012/0256550 | A1 | 10/2012 | Akiyama | |
| 2013/0342115 | A1 | 12/2013 | Yang | |
| 2014/0145628 | A1 | 5/2014 | Wang | |

FOREIGN PATENT DOCUMENTS

| | | | |
|---|---|---|---|
| KR | 2019910000985 | | 11/1991 |
| KR | 1020100049527 | | 5/2010 |
| KR | 1020110090201 | | 8/2011 |
| KR | 1020110128426 | | 11/2011 |
| KR | 2012-0026949 | A | 3/2012 |
| KR | 1020120026949 | | 3/2012 |
| KR | 10-2012-0069512 | A | 6/2012 |
| KR | 1020120069512 | | 6/2012 |
| KR | 10-2012-0078999 | A | 7/2012 |
| KR | 1020120078999 | | 7/2012 |
| KR | 101267278 | | 5/2013 |
| KR | 101301087 | | 8/2013 |
| KR | 1020130105212 | | 9/2013 |
| KR | 1020130112369 | | 10/2013 |
| KR | 1020140097817 | | 8/2014 |
| KR | 1020140100393 | | 8/2014 |
| KR | 1020140102966 | | 8/2014 |
| WO | WO2009/034613 | | 3/2009 |
| WO | WO2011/077909 | | 6/2011 |

OTHER PUBLICATIONS

Communication from European Patent Office dated Nov. 10, 2017 in corresponding EP Application No. 15795821, enclosing Supplemental European Search Report.

* cited by examiner (a)

(b)

| | CS1 | BS1 | CS2 | BS2 | CS3 | BS3 | CS4 | BS4 | CS5 |
|---|---|---|---|---|---|---|---|---|---|
| P0 | ON | ON | ON | ON | ON | ON | ON | ON | ON |
| P1 | ON | ON | ON | ON | ON | ON | ON | ON | ON |
| P2 | OFF | OFF | ON | ON | ON | ON | ON | ON | ON |
| P3 | OFF | OFF | OFF | OFF | ON | ON | ON | ON | ON |
| P4 | OFF | OFF | OFF | OFF | OFF | OFF | ON | ON | ON |
| P5 | OFF | OFF | OFF | OFF | OFF | OFF | OFF | OFF | ON |

LED LIGHTING DEVICE USING AC POWER SUPPLY

CROSS-REFERENCE TO RELATED APPLICATION(S)

This application is a Continuation of U.S. application Ser. No. 15/356,636 filed on Nov. 20, 2016, which is a Continuation of U.S. application Ser. No. 14/763,668, filed on Jul. 27, 2015, now U.S. Pat. No. 9,572,212, which is the National Entry of the International Application No. PCT/KR2015/000318, filed Jan. 13, 2015, claiming priority to Korean Patent Application No. 10-2014-0061077, filed on May 21, 2014, Korean Patent Application No. 10-2014-0149071, filed on Oct. 30, 2014, Korean Patent Application No. 10-2014-0160628, Nov. 18, 2014, the entire contents of which are incorporated herein by reference in their entirety.

TECHNICAL FIELD

The present disclosure relates to a lighting device, and more particularly, to a light emitting diode (LED) lighting device using an alternating current (AC) power supply.

BACKGROUND ART

A light emitting diode (LED) indicates a kind of semiconductor device that may implement light having various colors by configuring a light source through the PN diode formation of a compound semiconductor. Such a light emission element has advantages in that it has a long life, may be decreased in size and weight and driven at a low voltage. Also, such an LED is resistant to a shock and vibration, does not need a preheating time and complex operation, is mounted on a substrate or lead frame in various shapes, and then may be packaged. Thus, it is possible to modularize the LED for many uses and apply it to a backlight unit or various lighting devices.

A plurality of LEDs may be used in order to provide single independent lighting, in which case the LEDs may be connected in series or in parallel with each other. In this case, in order to always keep all of the LEDs being turned on, it is possible to convert commercial AC power supply into DC power and apply the DC power to the LEDs.

The method above needs a separate DC rectifier when the DC power is supplied, but other methods may apply the AC power supply directly to the LEDs without the DC rectifier. In this case, the LEDs may be connected in series with each other and the ON/OFF state of each of the LEDs may vary according to the size of a variable input voltage. Thus, there are limitations in that flicker occurs due to the repetition of ON/OFF state, the availability of each LED decreases and thus light output efficiency decreases.

Although the lighting device including the LEDs is driven with the AC power supply, it may be helpful to use the AC power supply without using a DC power supply device (1) if it is possible to remove or mitigate flicker and (2) if it is possible to prevent a decrease in power factor according to an AC power supply operation.

The peak voltage of the commercial AC power supply may depend on the region. In this case, when a single lighting device using LEDs is applied to AC power supply having different sizes, the brightness of the lighting device may vary and power efficiency may also vary. Thus, there is a need for LED lighting for AC power supply that may represent uniform light output and efficiency even when AC power supply having different sizes is applied.

DISCLOSURE

Technical Problem

The present disclosure provides a technology related to a light emitting diode (LED) driving device that may increase the availability of LED and efficiency in light output by solving the above limitations in an LED driving method by which AC power supply is directly applied.

Also, the present disclosure provides an LED driving device that may support heterogeneous power supplies.

Technical Solution

<Lighting Device Enabling Connection Configuration Between LEDs to be Automatically Switched to Series and Parallel Configurations>

In accordance with an exemplary embodiment, a lighting device includes a light emission unit including a current input terminal, a current output terminal, a current bypass output terminal, and a first light emission group emitting light by a current input through the current input terminal; and a second light emission group connected to receive at least part of current output through the current output terminal. The current output terminal are configured to selectively output all or at least part of current input through the current input terminal, and the current bypass output terminal is configured to output remainder excluding the at least some of the currents when the current output terminal outputs only the at least part of the current.

The light emission unit may further include a first bypass part connected between the current input terminal and the current output terminal, wherein a part of current input through the current input terminal may flows through a bypass path provided by the first bypass part when the first bypass part is in an ON state, and the current input through the current input terminal may not flow through the bypass path when the first bypass part is in an OFF state, wherein a change between the ON and OFF states of the first bypass part may be controlled by a voltage of the current output terminal.

The first bypass part may include a resistor having a terminal connected to the current output terminal and the other terminal connected to the first light emission group; a transistor connected between the other terminal and the current input terminal; and a bias voltage supplying element configured to generate a predetermined potential difference to be between a gate of the transistor and the current output terminal.

The light emission unit may further include a second bypass part connected between the current bypass output terminal and an output part of the first light emission group, wherein the second bypass part may be in an ON state when the first bypass part is in an ON state, and the second bypass part may be in an OFF state when the first bypass part is in an OFF state.

The current output terminal may be configured to output the at least part of current when a voltage applied to the current input terminal is a first potential, and configured to output all of the current when the voltage applied to the current input terminal is a second potential greater than the first potential.

The light emission unit may further include a reverse-current breaking part, wherein the reverse-current breaking part may be connected between a contact point at which the second bypass part is in contact with an output part of the first light emission part, and the other terminal of the resistor.

The second light emission group may be included in another current input terminal, another current output terminal, another current bypass output terminal, and the second light emission group emitting light by a current input through the another current input terminal. The another current input terminal may be electrically connected to the current output terminal, the another current output terminal may be configured to output all or at least part of current input through the another current input terminal, the another current bypass output terminal may be configured to output remainder of the current input through the another current input terminal when the another current output terminal outputs only the at least part of the current input through the another current input terminal, and the lighting device may further include a third light emission group connected to receive at least part of the current output through the another current output terminal.

The another light emission unit may further include another first bypass part connected between the another current input terminal and the another current output terminal, wherein a part of the current input through the another current input terminal may flows through one another bypass path provided by the another first bypass part when the another first bypass part is in an ON state, and the current input through the another current input terminal may not flow through the one another bypass path when the another first bypass part is in an OFF state, wherein a change between the ON and OFF states of the another first bypass part may be controlled by a voltage of the another current output terminal.

The another first bypass part may further include: another resistor having a terminal connected to the another current output terminal and the other terminal connected to the second light emission group; another transistor connected between the other terminal of the another resistor and the another current input terminal; and another bias voltage supplying element configured to generate a predetermined potential difference to be between a gate of the another transistor and the another current output terminal.

The another light emission unit may include another second bypass part connected between the another current bypass output terminal and an output part of the second light emission group, wherein when the another first bypass part is in an ON state, the another second bypass part may also be in an ON state, and when the another first bypass part is in an OFF state, the another second bypass part may also be in an OFF state.

The another current output terminal may be configured to output the at least part of the current input through the another current input terminal when a voltage applied to the another current input terminal is a third potential, and configured to output all of the current input through the another current input terminal when the voltage applied to the another current input terminal is a fourth potential greater than the third potential.

The another light emission unit may further include another reverse-current breaking part, wherein the another reverse-current breaking part may be connected between a contact point at which an output of the second light emission group is in contact with the another second bypass part, and the other terminal of the another resistor.

In accordance with the other exemplary embodiment, the lighting device includes a power supply part supplying power having a variable potential; a plurality of light emission groups electrically connected to each other to have an turn from an upstream side to a downstream side and receiving power from the power supply part; a first bypass part; and a second bypass part. Each of the light emission groups includes at least one light emission element, both the first bypass part and the second bypass part are included in a light emission unit to which a first light emission group having any turn belongs, the first bypass part is configured to controllably and electrically connect an upstream part of the first light emission group and an upstream part of a second light emission group having any turn disposed at a relatively downstream side than the first light emission group, the second bypass part is configured to controllably and electrically connect a downstream part of the first light emission group and ground, and a contact point at which the second bypass part is connected to the downstream part of the first light emission group is disposed at an relatively upstream side than a contact point at which the first bypass part is connected to the upstream part of the second light emission group.

The first bypass part may be configured to operate as a constant current source when the first bypass part connects the upstream part of the first light emission group and the upstream part of the second light emission group.

A current may flow through the second bypass part when a current flows through the first bypass part, and any current may not flow through the second bypass part when the current does not flow through the first bypass part.

The lighting device may further include: a third light emission group having any turn disposed at a relatively downstream side than the second light emission group; and another first bypass part and another second bypass part, wherein (a) the another first bypass part may be configured to controllably and electrically connect another upstream part of the second light emission group disposed at a relatively downstream side than a contact point at which the first bypass part is connected to the upstream part of the second light emission group, and the downstream part of the second light emission group; the another second bypass part may be configured to controllably and electrically connect the downstream part of the second light emission group and ground; and a contact point at which the another second bypass part is connected to the downstream part of the second light emission group may be disposed at a relatively upstream side than a contact point at which the another first bypass part is connected to the downstream part of the second light emission group. Alternatively, (b) The another first bypass part may be configured to controllably and electrically connect an upstream part of the third light emission group having any turn disposed at a relatively downstream side than the second light emission group, and a downstream part of the third light emission group; the another second bypass part may be configured to controllably and electrically connect the downstream part of the third light emission group and ground; and a contact point at which the another second bypass part is connected to the downstream part of the third light emission group may be disposed at a relatively upstream side than a contact point at which the another first bypass part is connected to the downstream part of the third light emission group.

The lighting device may further include a reverse-current breaking part, wherein the reverse-current breaking part may be connected to at least one of: (a) between a contact point at which the second bypass part is connected to the downstream part of the first light emission group, and a contact point at which the first bypass part is connected to the upstream part of the second light emission group, (b)

between a contact point at which the another second bypass part is connected to the downstream part of the second light emission group, and a contact point at which the another first bypass part is connected to the downstream part of the second light emission group, and (c) between a contact point at which the another second bypass part is connected to the downstream part of the third light emission group, and a contact point at which the another first bypass part is connected to the downstream part of the third light emission group.

In accordance with another exemplary embodiment, a lighting device includes a plurality of light emission groups linearly and electrically connected to have turns from a top upstream side to a bottom upstream side; a first circuit part connecting a connection point between the light emission groups and ground; and a second circuit part bypassing other connection points between the light emission groups, wherein all of the light emission groups from the top stream light emission group to the bottom downstream light emission group are sequentially switched from a parallel connection to a series connection while the potential of the AC power supply supplied rises, or all of the light emission groups from the bottom stream light emission group to the top downstream light emission group are sequentially switched from a series connection to a parallel connection while the potential of the AC power supply supplied falls. Each of the light emission groups includes one or more LED elements.

In accordance with another exemplary embodiment, a lighting device includes a light emission unit including a first light emission group, a first bypass part, a second bypass part, and a current input terminal connected to an input terminal of the first light emission group and an input terminal of the first bypass part in common and supplying a current to the first light emission group and the first bypass part; and a second light emission group connected to the light emission unit to receive a current output from an output terminal of the first light emission group in a first circuit configuration and to receive a current output from an output terminal of the first bypass part in a second circuit configuration. In the first circuit configuration, the first bypass part may be blocked to prevent a current from flowing through the first bypass part, and the second bypass part may be blocked to prevent a current output from the first light emission group from flowing through the second bypass part. In the second circuit configuration, a current may flow through the first bypass part and at least part of current output from the first light emission group may flow through the second bypass part, and a current flowing through the second bypass part when a current is supplied to the second light emission group may not flow to the second light emission group.

An output terminal of the second bypass part may be configured to be connected to Ground, the light emission unit may further include a current output terminal connected to the first bypass part, and whether to block the first bypass part may be adjusted by a voltage of the current output terminal.

The first bypass part may further include: a resistor having a terminal connected to the current output terminal and the other terminal connected to the first light emission group; a transistor connected between the other terminal and the current input terminal; and a bias voltage supplying element configured to generate a predetermined potential difference between a gate of the transistor and the current output terminal.

The first circuit configuration may represent a configuration having a first input voltage level, the second circuit configuration may represent a configuration having a second input voltage level, and the first input voltage level may be higher than the second input voltage level.

<Lighting Device in which Capacitor is Connected in Parallel with LED in Order to Decrease Flicker>

In accordance with an exemplary embodiment, a lighting device includes a light emission unit including a current input terminal, a current output terminal, a current bypass output terminal, a first light emission group emitting light by a current input to the current input terminal, a condenser (capacitor) connected in parallel with opposite ends of the first light emission group; and a second light emission group connected to receive at least some of currents output through the current output terminal. The current output terminal may be configured to selectively output all or at least some of currents input through the current input terminal, and the current bypass output terminal may be configured to output remainder excluding the at least some of the currents input through the current input terminal when the current output terminal outputs only the at least some of the currents.

The light emission unit may further include a first bypass part connected between the current input terminal and the current output terminal, wherein some of currents input through the current input terminal may flow through a bypass path provided by the first bypass part when the first bypass part is in an ON state, and the currents input through the current input terminal may not flow through the bypass path when the first bypass part is in an OFF state, wherein a switch between the ON and OFF states of the first bypass part may be adjusted by a voltage of the current output terminal.

The first bypass part may include a resistor having a terminal connected to the current output terminal and the other terminal connected to the first light emission group; a transistor connected between the other terminal and the current input terminal; and a bias voltage supplying element configured to allow a predetermined potential difference to be between a gate of the transistor and the current output terminal.

The ON/OFF states of the transistor may be determined according to whether a value obtained by adding a voltage across the resistor to a voltage between a first node being a connection point between the transistor and the other terminal and a second node being a connection point between the transistor and the bias voltage supplying element is less or greater than the predetermined potential difference.

The current bypass output terminal may include a second bypass part connected between an output part of the first light emission group and ground, and when the first bypass part is in an ON state, the second bypass part may be in an ON state, and when the first bypass part is in an OFF state, the second bypass part may be an OFF state.

The remainder may be at least some or all of currents flowing through the first light emission group.

The light emission unit may further include a reverse-current breaking part, wherein the reverse-current breaking part may be connected between a contact point at which the second bypass part is in contact with an output part of the first light emission part, and the other terminal of the resistor.

The second light emission group may be included in another light emission unit including another current input terminal, another current output terminal, another current bypass output terminal, the second light emission group emitting light by a current input to the another current input terminal, and a condenser connected in parallel with opposite ends of the second light emission group. The another current input terminal may be electrically connected to the current output terminal, the another current output terminal may be configured to selectively output all or at least some of second currents input through the another current input terminal, the another current bypass output terminal may be configured to output remainder excluding the at least some of the second currents input through the another current input terminal when the another current output terminal outputs only the at least some of the second currents, and the lighting device may further include a third light emission group connected to receive at least some of the currents output through the another current output terminal.

The current output terminal may be configured to output the at least some of currents when a voltage applied to the current input terminal is a first potential, and all of the currents when the voltage applied to the current input terminal is a second potential greater than the first potential.

In accordance with another exemplary embodiment, a lighting device includes a power supply part supplying power having a variable potential; a plurality of light emission groups electrically connected to each other to have an turn from an upstream side to a downstream side and receiving power from the power supply part; a first bypass part; and a second bypass part. Each of the light emission groups may include at least one light emission element, both the first bypass part and the second bypass part may be included in a light emission unit to which a first light emission group having any turn belongs, the first bypass part may be configured to controllably and electrically connect an upstream part of the first light emission group and an upstream part of a second light emission group having any turn disposed at a relatively downstream side than the first light emission group, the second bypass part is configured to controllably and electrically connect a downstream part of the first light emission group and ground. A contact point at which the second bypass part is connected to the downstream part of the first light emission group may be disposed at an relatively upstream side than a contact point at which the first bypass part is connected to the upstream part of the second light emission group, wherein a condenser is connected in parallel with opposite terminals of each of the plurality of light emission groups.

The first bypass part may be configured to operate as a constant current source when the first bypass part connects the upstream part of the first light emission group and the upstream part of the second light emission group.

A current may flow through the second bypass part when a current flows through the first bypass part, and may not flow through the second bypass part when the current does not flow through the first bypass part.

In accordance with another exemplary embodiment, a lighting device includes a plurality of light emission groups linearly and electrically connected to have turns from a top upstream side to a bottom downstream side; a first circuit part connecting a connection point between the light emission groups and ground; and a second circuit part bypassing other connection points between the light emission groups, wherein all of the light emission groups from the top upstream light emission group to the bottom downstream light emission group are sequentially switched from a parallel connection to a series connection while the potential of the AC power supply supplied rises, or all of the light emission groups from the bottom downstream light emission group to the top upstream light emission group are sequentially switched from a series connection to a parallel connection while the potential of the AC power supply supplied falls. Each of the light emission groups includes one or more LED elements and a condenser is connected in parallel with opposite terminals of each of the plurality light emission groups.

In accordance with another exemplary embodiment, a lighting device includes a light emission unit including a first light emission group, a first bypass part, a second bypass part, and a current input terminal connected to an input of the first light emission group and an input of the first bypass part in common and supplying a current to the first light emission group and the first bypass part; and a second light emission group connected to the light emission unit to receive a current output from an output of the first light emission group in a first circuit configuration and to receive a current output from an output of the first bypass part in a second circuit configuration. In the first circuit configuration, the first bypass part is blocked to prevent a current from flowing through the first bypass part, and the second bypass part is blocked to prevent a current output from the first light emission group from flowing through the second bypass part, and in the second circuit configuration, a current flows through the first bypass part and at least some of currents output from the first light emission group flow through the second bypass part, and a condenser is connected in parallel with each of the first light emission group and the second light emission group.

Whether to enable the flow of the current through the first bypass part may be adjusted by a voltage of the current output terminal of the first bypass part.

An output terminal of the second bypass part may be connected to ground.

The second light emission group may be included in another light emission unit having the same configuration as the light emission unit and include a third light emission group connected to another light emission unit is included to receive a current output from an output of the second light emission group in a third circuit configuration, and a current output from an output of the first bypass part in a fourth circuit configuration. A condenser may be connected in parallel with the third light emission group.

The first circuit configuration may represent a first temporal section and the second configuration may represent a second temporal section different from the first temporal section.

The first circuit configuration may represent a configuration having a first input voltage level, the second circuit configuration may represent a configuration having a second input voltage level, and the first input voltage level may be higher than the second input voltage level.

In accordance with another exemplary embodiment, a lighting device includes a first light emission unit including a current input terminal, a current output terminal, a current bypass output terminal, a light emission group emitting light by a current input to the current input terminal, a condenser connected in parallel with opposite ends of the light emission group, and a first bypass part connecting the current input terminal and the current output terminal; a second light emission unit having the same structure as the first light emission unit; and a third light emission unit including a current input terminal, a current output terminal, a light emission group emitting light by a current input to the current input terminal, and a condenser connected in parallel with both ends of the light emission group. The current output terminal of the first light emission unit may be connected to the current input terminal of the second light emission unit, the current output terminal of the second light emission unit may be connected to the current input terminal of the third light emission unit, and for each of the first and second light emission units, the current output terminal may be configured to selectively output all or some of currents input through the current input terminal and the current bypass output terminal may be configured to output remainder excluding some of the currents when the current output terminal outputs only some of the currents, and for each of the first and second light emission units, when the first bypass part is in an ON state, some of the current input through the current input terminal may flow through a bypass path provided by the first bypass part, and when the second bypass part is in an OFF state, the current input through the current input terminal may not flow through the bypass path, and for each of the first and second light emission units, a switch between the ON and OFF states of the first bypass part may be adjusted by a voltage of the current output terminal.

<Lighting Device Capable of being Used in Heterogeneous Power Supplies>

In accordance with an exemplary embodiment, a lighting device includes a first light emission part (=first LED part); a second light emission part (=second LED part); and a control voltage output part configured to output a control voltage according to a peak value of an input power supply input, and the first light emission part and the second light emission part are configured to mutually switch between series- and parallel-connection configurations according to a value of the control voltage.

The control voltage output part may include a peak detector configured to hold the peak value of the power supply input and output a peak voltage Vpeak; and a voltage comparator configured to output the control voltage having a value corresponding to a first logic value when the peak voltage is not higher than a predetermined value and a value corresponding to a second logic value when the peak voltage is higher than the predetermined value.

The first logic value may be logical High and the second logic value may be logical Low or vice versa.

The peak detector may include a diode and a condenser.

The lighting device may further include a switch part connecting a first upstream part of the first light emission part and a second upstream part of the second light emission part; and a reverse-current breaking part connecting a first downstream part of the first light emission part and the second upstream part thereof. The switch part may be configured to form a current path between the first upstream part and the second upstream part when the control value has the first logic value and block the current path when the control value has the second logic value.

The lighting device may further include a first driving part; and a second driving part, wherein the first driving part may control the value of a current flowing through the first LED part when the peak value of the input power supply has a first value, and may not control the value of the current flowing through the first LED part when the peak value of the input power supply has a second value greater than the first value, and the second driving part may control the value of the current flowing through the second LED part when the peak value of the input power supply has the first value, and may control the values of the currents flowing through the first and second LED parts when the peak value of the input power supply has the second value.

The internal circuit of the second driving part may be configured to have a first configuration when the peak value of the input power supply has the first value and a second configuration when the peak value of the input power supply has the second value, and the lighting device may be configured to have the same light output both when the peak value of the input power supply has the first value and when the peak value of the input power supply has the second value.

The first LED part may include a plurality of LED groups (LED channels or light emission groups) and the plurality of LED groups may be sequentially turned on from the upstream part to the downstream part of the plurality of LED groups when the voltage value of the input voltage rises.

The first LED part may include a plurality of LED groups and a connection between the plurality of LED groups may be switched from a parallel connection configuration to a series connection configuration when the voltage value of the input voltage rises.

The second LED part may include a plurality of LED groups and the plurality of LED groups may be sequentially turned on from the upstream part to the downstream part of the plurality of LED groups when the voltage value of the input voltage rises.

The second LED part may include a plurality of LED groups and a connection between the plurality of LED groups may be switched from a parallel connection configuration to a series connection configuration when the voltage value of the input voltage rises.

Advantageous Effect

According to the present disclosure, in an LED driving method of directly applying an AC power supply, it is possible to provide an LED driving device capable of increasing LED availability and light output efficiency, and it is possible to provide an LED driving device in which flicker is mitigated.

According to the present disclosure, in an LED driving method, it is possible to provide an LED driving device capable of mutually switching series and parallel connection configurations according to the peak value of an AC power supply voltage, and it is possible to provide an LED driving device capable of adjusting the total light output of the LED driving device to be the same irrespective of the input voltage of the AC power supply.

DESCRIPTION OF DRAWINGS

In FIG. 2, (b) to (e) respectively represents examples of the waveforms ID1 to ID4 of the currents in light emission groups CH1 to CH4 according to the input voltage Vi in (a) of FIG. 2, on temporal axes.

MODE FOR INVENTION

In the following, embodiments of the present disclosure are described with reference to the accompanying drawings. However, the present disclosure is not limited to embodiments to be described herein and may be implemented in many different forms. The terms used herein are to help readers understand embodiments and are not intended to limit the scope of the present disclosure. Also, singular terms used herein also include plural forms unless referred to the contrary.

Figure 1:
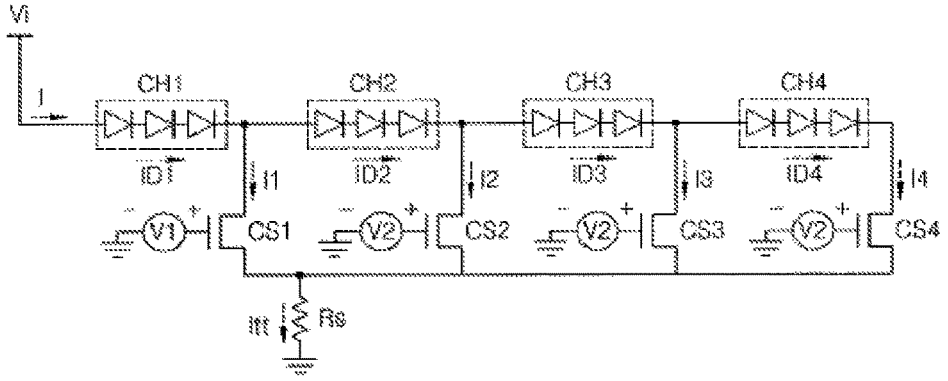
FIG. 1 represents an example of a circuit for an alternating current (AC) power direct LED lighting device having four channel light emission groups according to an embodiment.

FIG. 1 represents an example of a circuit for an alternating current (AC) power direct LED lighting device having a four-channel light emission group according to an embodiment. FIG. 1 illustrates that each of four light emission groups CH1 to CH4 includes three LEDs. A current I is controlled to satisfy the entire THD by current sources CSI to CSI4 connected to the current output of each of the light emission groups CH 1 to CH 4. The operation principle of the circuit in FIG. 1 is described in Korea Patent Laid-Open No. 10-2014-0100393 (published on Oct. 14, 2014), the contents of which are incorporated by reference in their entirety.

Figure 2:
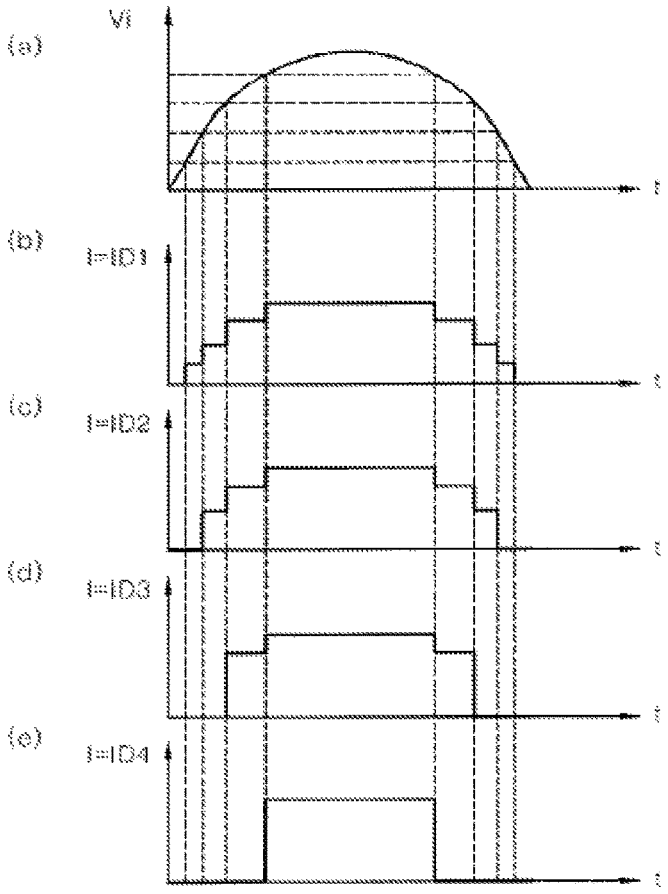
In FIG. 2, (a) represents an example of the waveform of the input voltage Vi of an input power supply in FIG. 1, on a temporal axis.

In FIG. 2, (a) represents an example of the waveform of the input voltage Vi of an input power supply in FIG. 1, on a temporal axis. In FIG. 2, (b) to (e) respectively represent examples of the current waveforms ID1 to ID4 in light emission groups CH1 to CH4 according to the input voltage Vi in (a) of FIG. 2, on temporal axes. According to (a) to (e) of FIG. 2, it is possible to recognize that light emission groups CH1 to CH4 have temporal sections in which currents do not flow, and it is possible to recognize that light emission groups disposed away from the AC power supply have longer temporal sections in which currents do not flow, and the shape of the current may be closer to a square wave over time.

<Lighting Device Enabling Connection Configuration Between LEDs to be Automatically Switched to Series and Parallel Configurations>

It is possible to see through FIG. 2 that in the LED lighting device in FIG. 1, the length of a first time in which the input power supply supplies power directly to a first light emission group is longer than that of a second time in which the input power supply supplies power directly to a second light emission group, when it is assumed that among the first and second light emission groups, the first light emission group is closer than the second light emission group to the input power supply.

The lighting devices according to first to eighth embodiments of the present disclosure may provide a configuration enabling the length of the first time to be substantially the same as that of the second time.

First Embodiment

Figure 3:
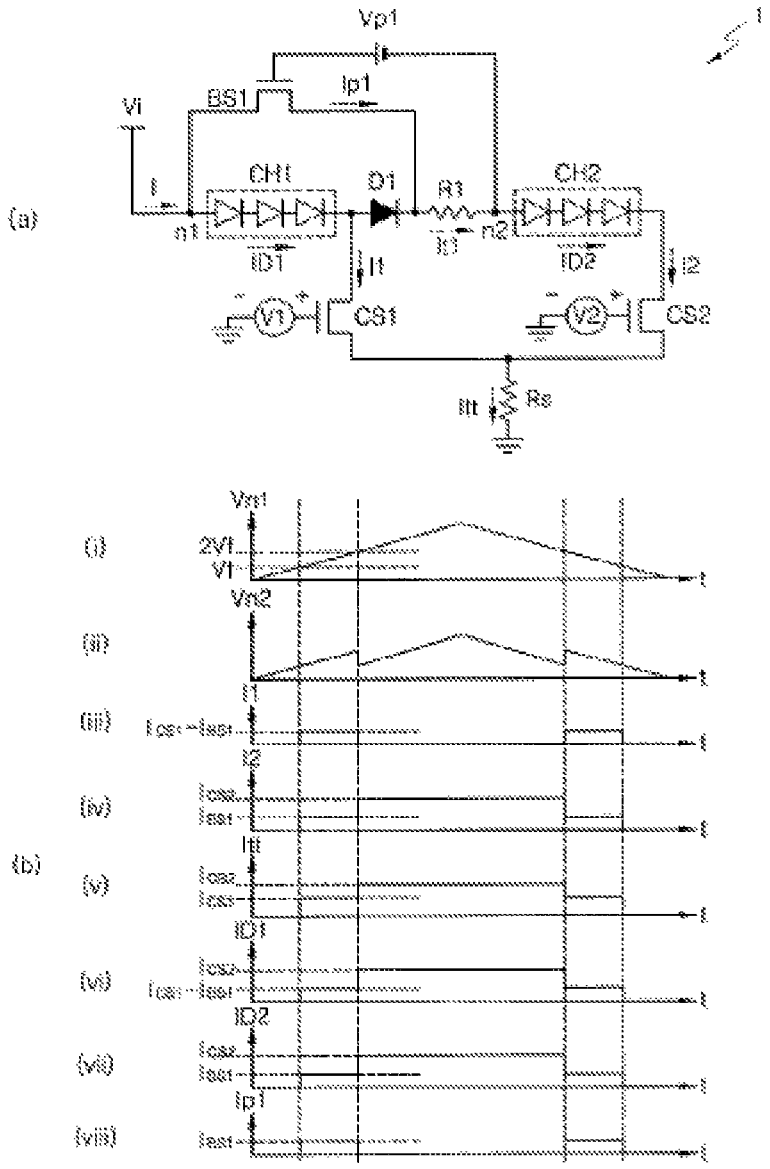
In FIG. 3, (a) to (b) represent examples of an LED lighting device according to a first embodiment of the present disclosure, and the operation principle thereof.

In FIGS. 3, (*a*) and 3 (*b*) represent examples of an LED lighting device according to a first embodiment of the present disclosure, and the operation principle thereof.

A plurality of light emission groups CH1 to CH2 are connected to the LED lighting device 1 in (a) of FIG. 3. The light emission groups CH1 and CH2 may be switched to series and parallel connection configurations, in which case the re-construction of the connection configuration may be performed by adjusting the ON/OFF states of a control switch CS1 and a bypass switch BS1. The ON/OFF states of the control switch CS1 and the bypass switch BS1 may be automatically adjusted according to the size of the input voltage Vi.

In (a) of FIG. 3, the bypass switch BS1 and the control switch CS1 may be transistors. The transistors include e.g., a bipolar transistor (BT), field effect transistor (FET), and insulated gate bipolar transistor (IGBT) but the scope of the present disclosure is not limited thereto.

When the bypass switch BS1 operates in a non-saturated region, the size of the current Ip1 flowing through the bypass switch BS1 may be determined by the ratio of a bias voltage Vp1 and a resistance R1. That is, a single current source may be provided by the bypass switch BS1, the resistance R1 and the bias voltage Vp1. Alternatively, when the bypass switch BS1 operates in a saturated region, the bypass switch BS1 may represent a characteristic similar to the resistance.

Also, when the control switch CS1 operates in a non-saturated region, the size of the current I1 flowing through the control switch CS1 may be determined by the ratio of a bias voltage V1 and a resistance Rs. That is, a single current source may be provided by the control switch CS1, the resistance Rs and the bias voltage V1. Alternatively, when the control switch CS1 operates in a saturated region, the control switch CS1 may represent a characteristic similar to the resistance.

In FIG. 3, (b) represents time vs. voltage and current characteristics in each node and element in the LED lighting device 1 in (a) of FIG. 3.

For the convenience of description, it is assumed below that the forward voltages of the light emission groups CH1 and CH2 all are Vf. In addition, it is assumed that the maximum current values designed to be capable of flowing through the bypass switch BS1, the control switch CS1, and a control switch CS2 are $I_{BS1}$ $I_{CS1}$ $I_{CS2}$, respectively.

When the input voltage Vn1 on a node n1 is 0 to Vf, a current does not flow through the circuit.

The input voltage Vn1 is Vf to 2Vf, the bypass switch BS1 and the control switch CS1 operate in the non-saturated region as a current source and the control switch CS2 may operate in the saturated region. In this case, a current having a size of $I_{BS1}$ may flow through the bypass switch BS1 and the control switch CS2. In this case, the size of the current flowing through the control switch CS1 may be a value obtained by subtracting, from the current $I_{CS1}$, the current value $I_{BS1}$ flowing the control switch CS2. In addition, the current ID1 flowing through the light emission group CH1 is equal to the current value $I_{CS1}-I_{BS1}$ flowing through the control switch CS1, and the current ID2 flowing through the light emission group CH2 is equal to the current value $I_{BS1}$ flowing through the control switch CS2. In this case, because the input voltage is not sufficiently high, a current does not flow through a diode D1.

When the input voltage Vn1 is equal to or higher than 2Vf, a current may flow through the diode D1. In this case, an additional current flows into a resistor R1 through the diode D1, so the bypass switch BS1 is switched to an OFF state. In addition, the control switch CS2 operates in a non-saturated region, and the control switch CS1 may be switched to an OFF state. In this case, a current having a size of $I_{CS2}$ may flow through the control switch CS2. In addition, the current ID1 flowing through the light emission group CH1 is equal to the current value $I_{CS2}$ flowing through the control switch CS2.

Second Embodiment

Figure 4:
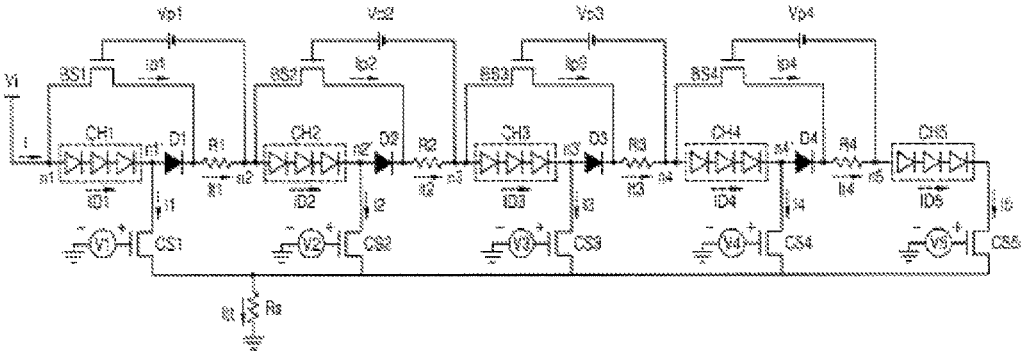
FIG. 4 represents an example of an LED lighting device according to a second embodiment of the present disclosure.

FIG. 4 represents an example of an LED lighting device according to a second embodiment of the present disclosure.

The LED lighting device 1 in FIG. 4 is represented by enlarging and modifying the LED lighting device in (a) of FIG. 3.

A plurality of light emission groups CH1 to CH5 are connected to the LED lighting device 1 in FIG. 4. The light emission groups CH1 to CH5 may have series and parallel configurations, in which case the re-construction of the connection configurations may be performed by adjusting the ON/OFF states of control switches CS1 to CS4 and bypass switches BS1 to BS4. The ON/OFF states of the control switches CS1 to CS4 and the bypass switches BS1 to BS4 may be automatically adjusted according to the size of the input voltage Vi.

Figure 5:
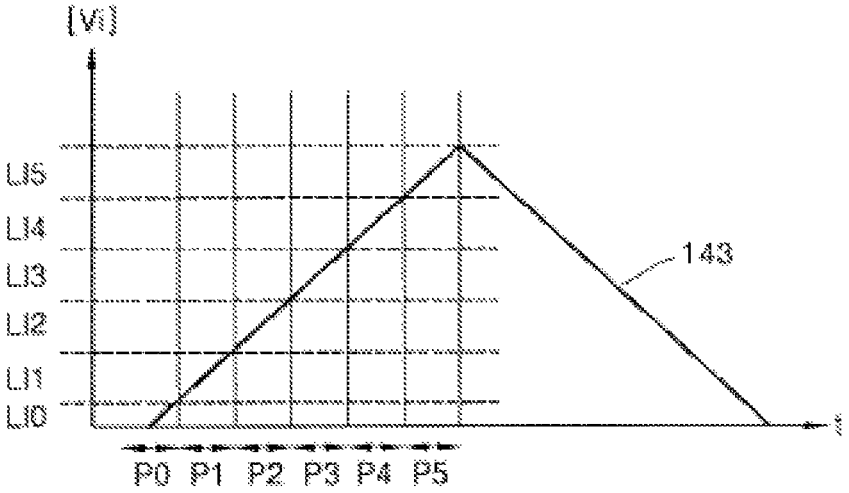
FIG. 5 represents ON/OFF states according to the respective input voltages of switches included in the LED lighting device in FIG. 4.

FIG. 5 represents ON/OFF states according to the respective input voltages of switches included in the LED lighting device in FIG. 4.

A graph 143 in (a) of FIG. 5 represents time vs. size of input voltage Vi according to an embodiment. The input voltage may also be a triangular wave as shown in (a) of FIG. 5 or alternatively, a square wave, sawtooth, etc.

In FIG. 5, the size of the input voltage Vi may be divided into a plurality of voltage sections LI0 to LI5, which may correspond to a plurality of temporal sections P0 to P5. The lengths and locations of the plurality of temporal sections P0 to P5 on the temporal axis may be determined by the particular values of the forward voltages of the light emission groups CH1 to CH5 in FIG. 4.

In each of the temporal sections P0 to P5 in (a) of FIG. 5, an LED circuit according to an embodiment of the present disclosure may operate as a steady state. Between the temporal sections P0 to P5, the LED circuit may, however, operate as a transient state in which the state of the LED circuit is switched. The present disclosure mostly describes the steady state for the convenience of description.

Each row in (b) of FIG. 5, represents temporal sections P0 to P5 and each column represents ON/OFF states according to temporal sections P0 to P5 of switches BS1 to BS4 and CS1 to CS5 in FIG. 4. A change in ON/OFF state may be automatically performed by the fundamental structure of the LED lighting device 1 in FIG. 3.

In the following, the operation principle of the LED lighting device 1 is described with further reference to FIGS. 5 to 7.

Figure 6A:
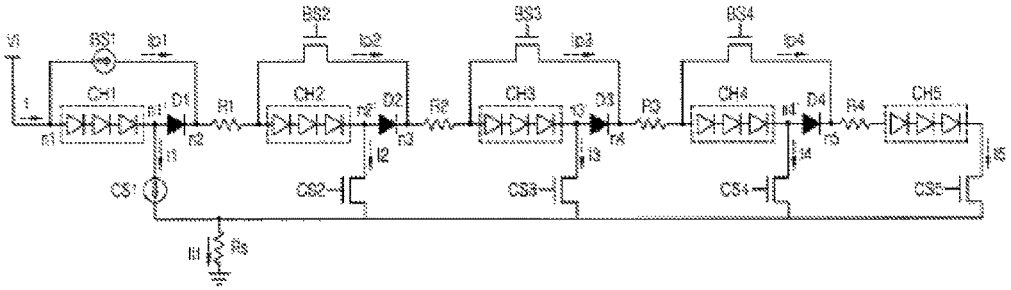
FIGS. 6A to 6E represent the circuit structures of an LED lighting device 1 in temporal sections P1 to P5, respectively.

FIGS. 6A to 6E represent the circuit structures of an LED lighting device 1 in temporal sections P1 to P5, respectively. In addition, FIG. 6A represents the configuration of the LED lighting device 1 in the temporal section P0 as well as in the temporal section P1.

At the temporal section P0, none of the light emission groups CH1 to CH5 may be turned on, because the size of the input voltage Vi is not sufficiently high.

Figure 7A:
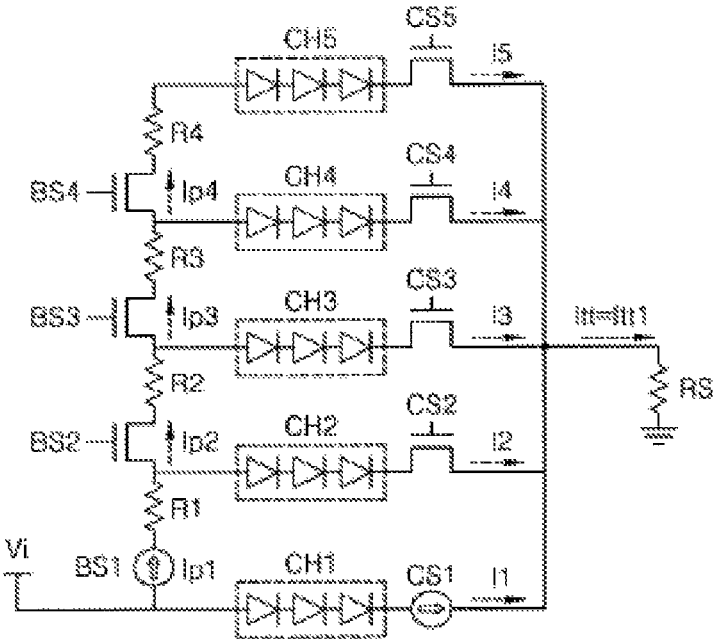
FIGS. 7A to 7E represent approximated equivalent circuits of the circuits in FIGS. 6A to 6E.

At the temporal section P1, the circuit in FIG. 4 has a structure as represented in FIG. 6A, because the bypass switches BS1 to BS4 and the control switches CS1 to CS5 are all turned on. In this case, the bypass switch BS1 and the control switch CS1 among the turned-on switches operate in a non-saturated region and may function as a current source. In addition, the remainder among the turned-on switches may work in a saturated region. In this case, since the anode voltages of the reverse-current breaking diodes D1 to D4 are higher than cathode voltages thereof, it may be considered that opposite ends of these diodes are open. Thus, the circuit in FIG. 6A may be represented by an equivalent circuit as shown in FIG. 7A.

Figure 6B:
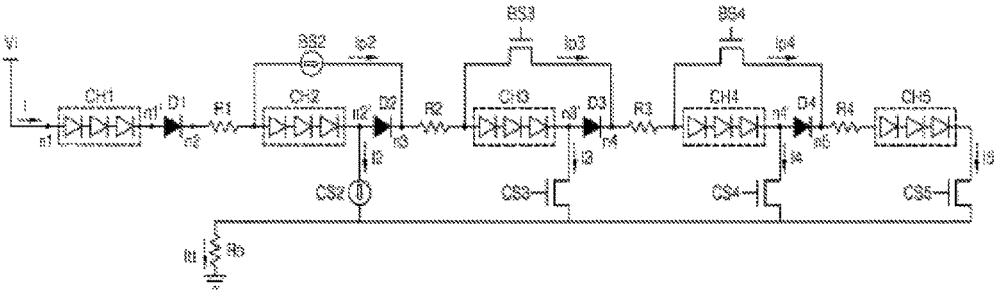
Figure 7B:
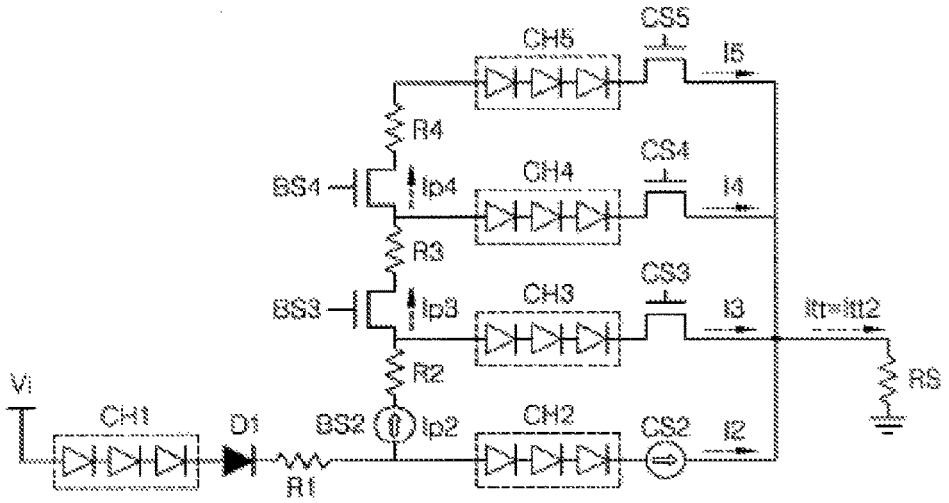

At the temporal section P2, since the bypass switches BS2 to BS4 and the control switches CS2 to CS5 are all turned on and the bypass switch BS1 and the control switch CS1 are all turned off, the circuit in FIG. 4 has a structure as shown in FIG. 6B. In this case, the bypass switch BS2 and the control switch CS2 among the turned-on switches operate in a non-saturated region and may function as a current source. In addition, the remainder among the turned-on switches may work in a saturated region. In this case, since the anode voltages of the reverse-current breaking diodes D2 to D4 are higher than cathode voltages thereof, it may be considered that opposite ends of these diodes are open. Thus, the circuit in FIG. 6B may be represented by an equivalent circuit as represented in FIG. 7B.

Figure 6C:
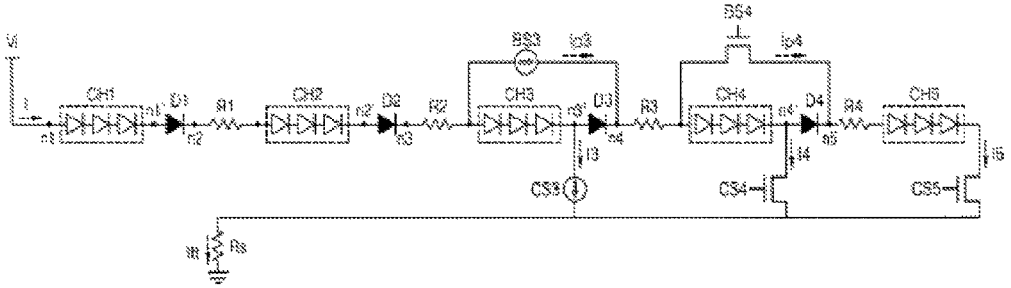
Figure 7C:
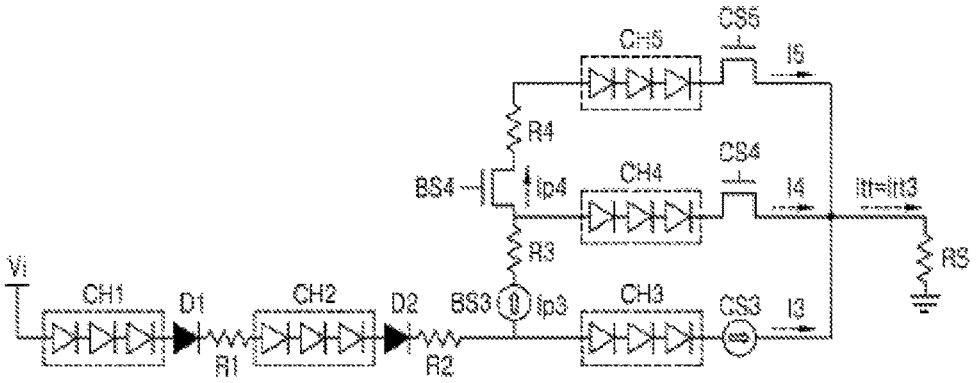

At the temporal section P3, since the bypass switches BS3 and BS4 and the control switches CS3 to CS5 are all turned on and the bypass switches BS1 and BS2 and the control switches CS1 and CS2 are all turned off, the circuit in FIG. 4 has a structure as shown in FIG. 6C. In this case, the bypass switch BS3 and the control switch CS3 among the turned-on switches operate in a non-saturated region and may function as a current source. In addition, the remainder among the turned-on switches may work in a saturated region. In this case, since the anode voltages of the reverse-current breaking diodes D3 and D4 are higher than cathode voltages thereof, it may be considered that opposite ends of these diodes are open. Thus, the circuit in FIG. 6C may be represented by an equivalent circuit as shown in FIG. 7C.

Figure 6D:
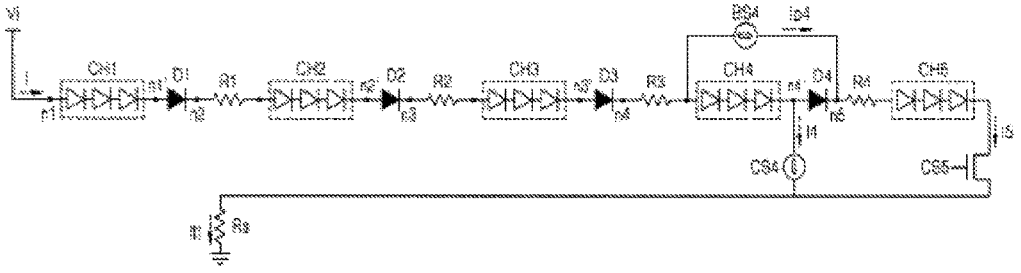
Figure 7D:
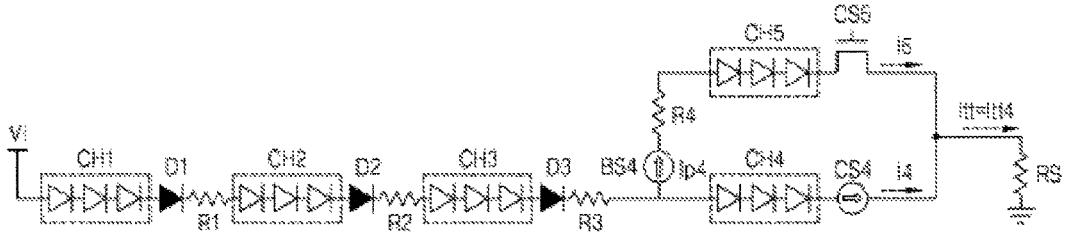

At the temporal section P4, since the bypass switch BS4 and the control switches CS4 and CS5 are all turned on and the bypass switches BS1 to BS3 and the control switches CS1 to CS3 are all turned off, the circuit in FIG. 4 has a structure as shown in FIG. 6D. In this case, the bypass switch BS4 and the control switch CS4 among the turned-on switches operate in a non-saturated region and may function as a current source. In addition, the remainder among the turned-on switches may work in a saturated region. In this case, since the anode voltages of the reverse-current breaking diode D4 is higher than cathode voltage thereof, it may be considered that opposite ends of the diode are open. Thus, the circuit in FIG. 6D may be represented by an equivalent circuit as shown in FIG. 7D.

Figure 6E:
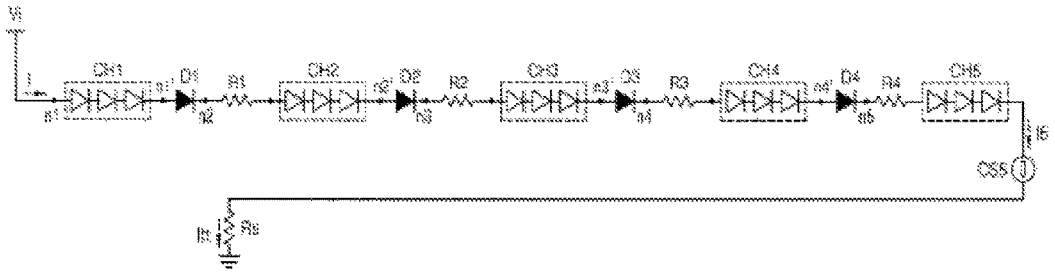
Figure 7E:
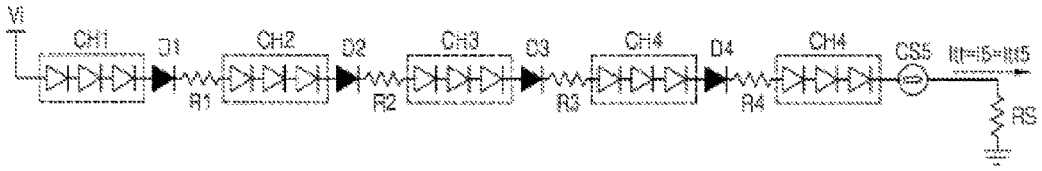

At the temporal section P5, since the control switch CS5 is turned on and the bypass switches BS1 to BS4 and the control switches CS1 to CS4 are all turned off, the circuit in FIG. 4 has a structure as represented in FIG. 6E. In this case, the control switch CS5 operates in a non-saturated region and may function as a current source. The circuit in FIG. 6E may be represented by an equivalent circuit as shown in FIG. 7E.

As described above, it may be understood that FIGS. 7A to 7E represent approximated equivalent circuits of circuits in FIGS. 6A to 6E, respectively.

When looking into the equivalent circuits in FIGS. 7A to 7E, it may be understood that the circuit structure of the LED lighting device 1 in FIG. 4 changes according to the size of the input voltage Vi.

In FIG. 7A representing a configuration at the temporal section P1, the light emission groups CH1 to CH5 are connected in parallel with each other.

In FIG. 7B representing the temporal section P2, the light emission groups CH2 to CH5 are connected in parallel with each other and the light emission group CH1 is connected in series with them.

In FIG. 7C representing the temporal section P3, the light emission groups CH3 to CH5 are connected in parallel with each other and the light emission groups CH1 and CH2 are connected in series with them.

In FIG. 7D representing the temporal section P4, the light emission groups CH4 and CH5 are connected in parallel with each other and the light emission groups CH1 to CH3 are connected in series with them.

In FIG. 7E representing the temporal section P5, the light emission groups CH1 to CH5 are connected in series with each other In the circuits in FIGS. 7A to 7E, the sum of currents input to and output from the LED lighting device at the temporal sections P1 to P5 may be defined as Itt1, Itt2, Itt3, Itt4, and Itt5, respectively. In this case, design may be implemented to satisfy the relation Itt5>Itt4>Itt3>Itt2>Itt1. When the design is implemented in this way, it is possible to enhance the power factor of the LED lighting device because there is a tendency for the sum of supplied currents to also increase with an increase in the size of the input voltage Vi.

Third Embodiment

In the following, a third embodiment designed to satisfy the above-described relation Itt5>Itt4>Itt3>Itt2>Itt1 is described with reference to FIGS. 7A to 7E.

In FIG. 7A, the control switch CS1 operates in a non-saturated region, and the value of I1 is adjusted so that I1+I2+I3+I4+I5 is the same value as the $I_{CS1}$, the maximum current value which the control switch CS1 may pass. In this case, the ratio between I1 and I2+I3+I4+I5 may be determined by the maximum current value $I_{BS1}$ provided when the bypass switch BS1 operates as a current source. Thus, the equation Itt1=$I_{CS1}$ is completed.

In FIG. 7B, the control switch CS2 operates in a non-saturated region, and the value of I2 is adjusted so that I2+I3+I4+I5 is the same value as the $I_{CS2}$, the maximum current value which the control switch CS2 may pass. In this case, the ratio between I2 and I3+I4+I5 may be determined by the maximum current value $I_{BS2}$ provided when the bypass switch BS2 operates as a current source. Thus, the equation Itt2=$I_{CS2}$ is completed.

In FIG. 7C, the control switch CS3 operates in a non-saturated region, and the value of I3 is adjusted so that I3+I4+I5 is the same value as the $I_{CS3}$, the maximum current value which the control switch CS3 may pass. In this case, the ratio between I3 and I4+I5 may be determined by the maximum current value $I_{BS3}$ provided when the bypass switch BS3 operates as a current source. Thus, the equation Itt3=$I_{CS3}$ is completed.

In FIG. 7D, the control switch CS4 operates in a non-saturated region, and the value of I4 is adjusted so that the value of I4+I5 is the same value as the the maximum current value which the control switch CS4 may pass. In this case, the ratio between I4 and I5 may be determined by the maximum current value $I_{BS4}$ provided when the bypass switch BS4 operates as a current source. Thus, the equation Itt4=$I_{CS4}$ is completed.

In FIG. 7E, the control switch CS5 operates in a non-saturated region. Thus, the equation Itt5=$I_{CS5}$ is completed.

In order to homogenize the relative brightness between the light emission groups CH1 to CH5 at a specific moment if possible, design may be implemented by optimizing the maximum current value that may be provided when the switches CS1 to CS5 and BS1 to BS4 operate as a current source

Fourth Embodiment

Figure 8A:
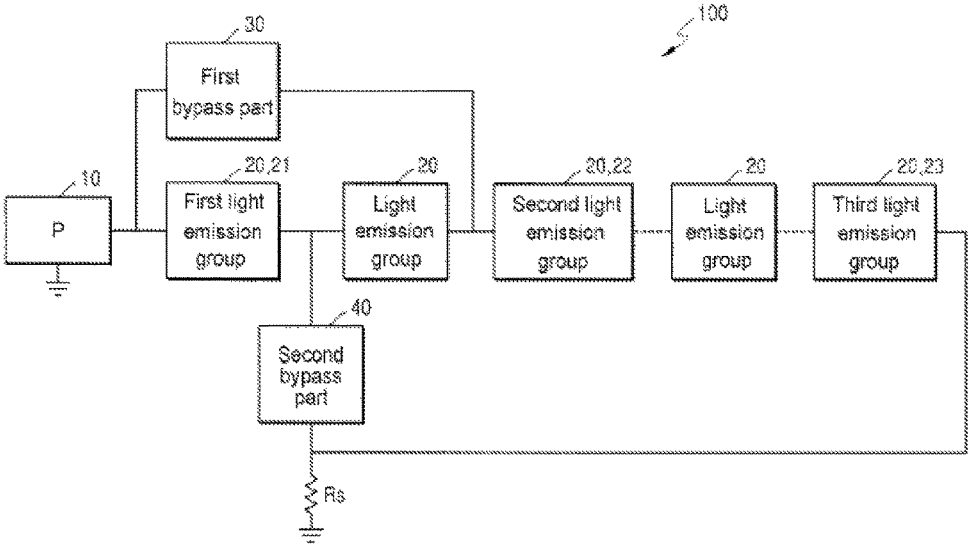
FIG. 8A is a diagram for explaining the structure of a light emission device according to a fourth embodiment of the present disclosure.

FIG. 8A is a diagram for explaining the structure of a light emission device according to a fourth embodiment of the present disclosure.

A light emission device 100 in FIG. 8A may be the above-described LED lighting device 1.

The light emission device 100 may include a power supply part 10 supplying power having a variable potential and a plurality of light emission groups 20.

In this case, each of the light emission groups 20 includes at least one light emission element 901, and the light emission groups are electrically connected to each other so that they have an turn from an upstream direction to a downstream direction, and the light emission groups 20 receive power from the power supply part 10. In this example, the 'upstream direction' may mean that the light emission groups 20 is disposed closer to the current output terminal of the power supply part 10, and the 'downstream direction' may mean that the light emission groups 20 is disposed far from the current output terminal of the power supply part 10.

In addition, the light emission device 100 may include a first bypass part 30 that controllably and electrically connects the upstream part of a first light emission group 20, 21 having any turn to the upstream part of a second light emission group 20, 22 having any turn and more downstream disposed than the first light emission group 20, 21. In this example, the 'upstream part' may mean a terminal closer to the power supply part 10 among terminals provided to the light emission groups (i.e., a current input terminal), and the 'downstream part' may mean a terminal farther from the power supply part 10 among terminals provided to the light emission groups (i.e., a current output terminal). In this example, the 'controllable' means that it is possible to form or block (connect or disconnect) current flow channels between opposite terminals provided by the first bypass part 30.

In addition, the light emission device 100 may include a second bypass part 40 that controllably and electrically connects the downstream part of the first light emission groups 20, 21 to the downstream part of the second light emission group 20, 22 or to the downstream part of a third light emission group 20, 23 having any turn and more downstream disposed than the second light emission group 20, 22. In this example, the 'controllable' means that it is possible to connect or disconnect current flow channels between opposite terminals provided by the second bypass part 40.

Figure 8B:
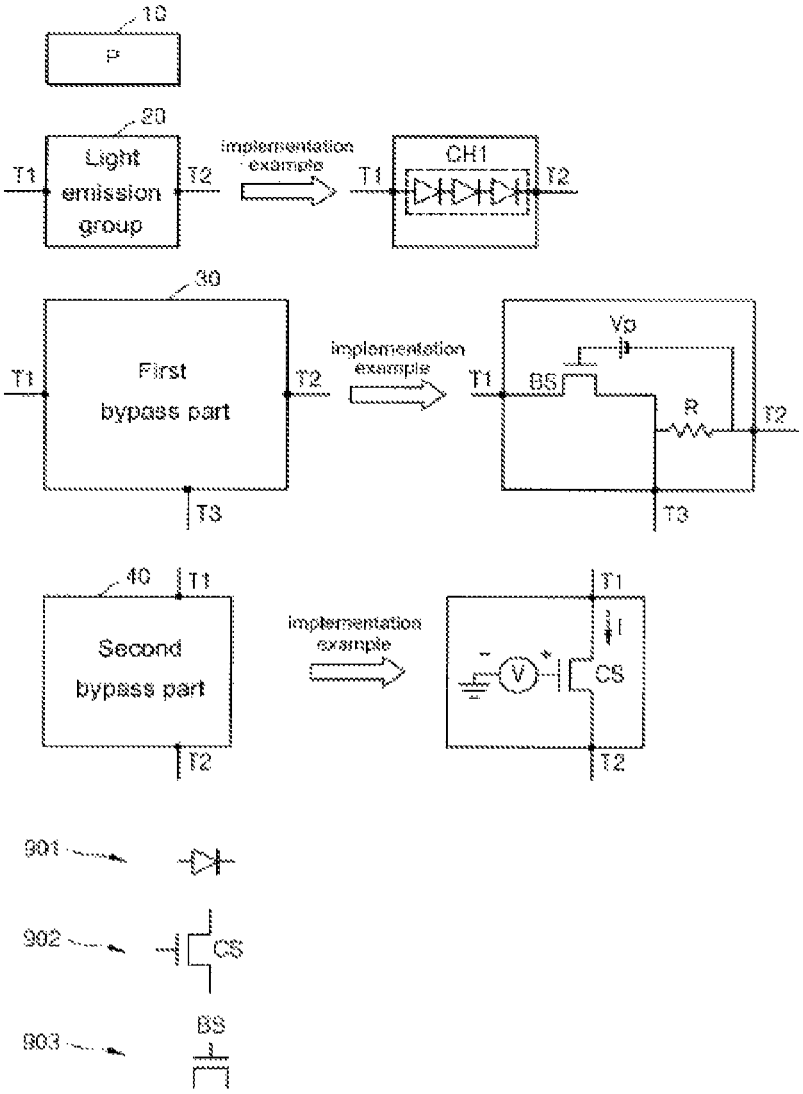
FIG. 8B represents examples of a power supply unit, a light emission group, a first bypass part, a second bypass part, and a light emission element in FIG. 8A.

FIG. 8B represents the power supply unit 10, the light emission group 20, the first bypass part 30, and the second bypass part 40 in FIG. 8A, and a light emission element 901. Among others, the particular implementations of the light emission group 20, the first bypass part 30, and the second bypass part 40 are shown together. Such implementations are applied to the LED lighting device in FIG. 4. In this case, the circuit connected between the terminals T1 and T2 provided by the first bypass part 30 may be controlled by a bypass switch BS 903. A third terminal T3 may also be selectively provided to the first bypass part 30 in some embodiments. In addition, the circuit between opposite terminals T1 and T2 provided by the second bypass part 40 may be controlled by a control switch CS 902.

In various embodiments of the present disclosure, the power supply part 10 may also be referred to as the term "rectifier" or "power supply"

In addition, the light emission group 20 may also be referred to as the term 'light emission channel' or 'LED light emission family'.

In addition, the first bypass part 30 may also be referred to as the term 'jump circuit part', 'bypass line', or 'first circuit part'.

In addition, the second bypass part 40 may also be referred to as the term 'distribution circuit part' or 'second circuit part'.

In addition, the light emission element 901 may also be referred to as the term 'LED cell' or 'LED element'.

In addition, the bypass switch 903 may also be referred to as a 'jump switch'.

Fifth Embodiment

Figure 9:
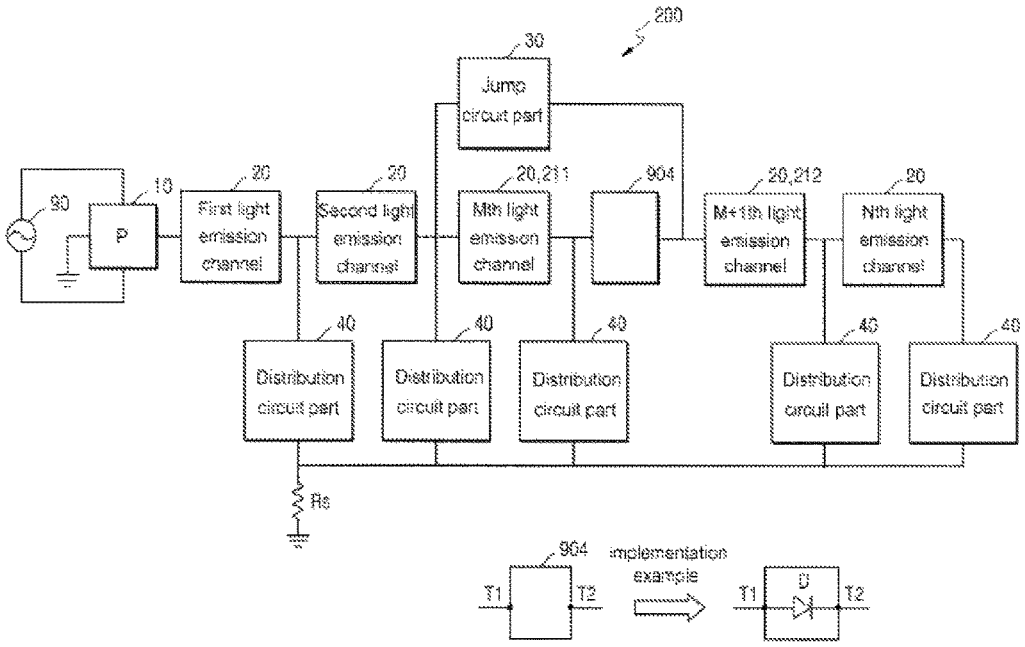
FIG. 9 is a diagram for explaining the structure of an LED lighting device 200 according to a fifth embodiment of the present disclosure.

FIG. 9 is a diagram for explaining the structure of an LED lighting device 200 according to a fifth embodiment of the present disclosure.

The LED lighting device 200 may receive operating power from an AC power supply 90.

The LED lighting device 200 includes at least one LED cell 901 and may include N light emission channels 20 that are linearly connected (where N is a natural number equal to or larger than 2).

In addition, the LED lighting device 200 may include the rectifier 10 that is electrically connected to the start part of the light emission channels 20 and rectifies the AC power supply 90 so that power is supplied to the last part of the light emission channels. In this example, the start part may mean a light emission channel disposed closest to the current output terminal of the rectifier 10 among the light emission channels 20, and the last part may mean a light emission channel disposed farthest therefrom.

In addition, the LED lighting device 200 may include a plurality of distribution circuit parts 40 that is branched from each connection part between the light emission channels 20 and connected to ground, and includes a control switch 902 controlling a current flowing on the connection path.

In addition, the LED lighting device 200 may include a jump circuit part 30 that is branched from the input of an Mth light emission channel 20, 211 among the light emission channels 20 and connected to the input of an M+1th light emission channel 20, 212, and includes a jump switch 903 controlling a current flowing on the connection path.

In addition, the LED lighting device 200 may further include a reverse-current breaking part 904 that is disposed on the line between the connection between the Mth light emission channel 20, 211 and the M+1th light emission channel 20, 212 and the input of the M+1th light emission channel 20, 212, and prevents a current flowing to the input of the M+1th light emission channel 20, 212 through the jump circuit part 30 from flowing toward the rectifier 10.

FIG. 9 also represents an implementation of the reverse-current breaking part 904. The reverse-current breaking part 904 may be implemented as a diode D or transistor. An example of the transistor is as described above. Such an implementation is applied to the LED lighting device 1 in FIG. 4. The reverse-current breaking part 904 may also be implemented as a transistor, not as the diode, in which case it is possible to control the ON/OFF state of the transistor according to each of the temporal sections P0 to P5.

The jump circuit part 30, the light emission channel 20, and the distribution circuit part 40 in FIG. 9 may also be implemented in the same structure as the first bypass part, the light emission group, and the second bypass part in FIG. 8A, respectively.

Sixth Embodiment

Figure 10:
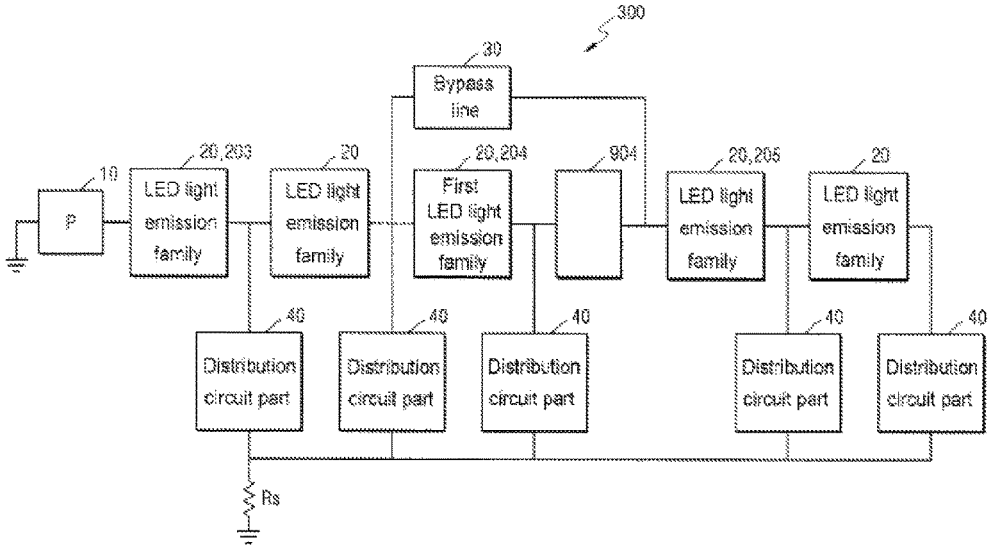
FIG. 10 is a diagram for explaining the structure of an LED lighting device 300 according to a sixth embodiment of the present disclosure.

FIG. 10 is a diagram for explaining the structure of an LED lighting device 300 according to a sixth embodiment of the present disclosure.

The LED lighting device 300 may have a structure in which a plurality of LED light emission families 20 having at least one LED element 901 is sequentially connected.

In addition, the LED lighting device 300 may include a power supply 10 applying AC power supply to an LED light emission family 20, 203 disposed at one side among the LED light emission families 20.

In addition, the LED lighting device 300 may include a bypass line 30 that connects the input and output of a first LED light emission family 20, 204 that is at least any one of the LED light emission families 20.

In addition, the LED lighting device 300 may include a bypass switch 903 that is disposed on the bypass line 30 and closes the bypass line 30 when the potential of power supplied by the power supply 10 is not higher than a potential capable of turning on the next LED light emission family 20, 205 of the first LED light emission family 20, 204.

The bypass line 30, the LED light emission family 20, and the distribution circuit part 40 in FIG. 10 may also be implemented in the same structure as the first bypass part, the light emission group, and the second bypass part in FIG. 8A, respectively. In this case, since the above-described reverse-current breaking part 904 is disposed between the current output terminal of the bypass line 30 and the current output terminal of the first LED light emission family 20, 204, it is possible to prevent the current output from the current output terminal of the bypass line 30 from flowing toward the first LED light emission family 20, 204.

Seventh Embodiment

Figure 11:
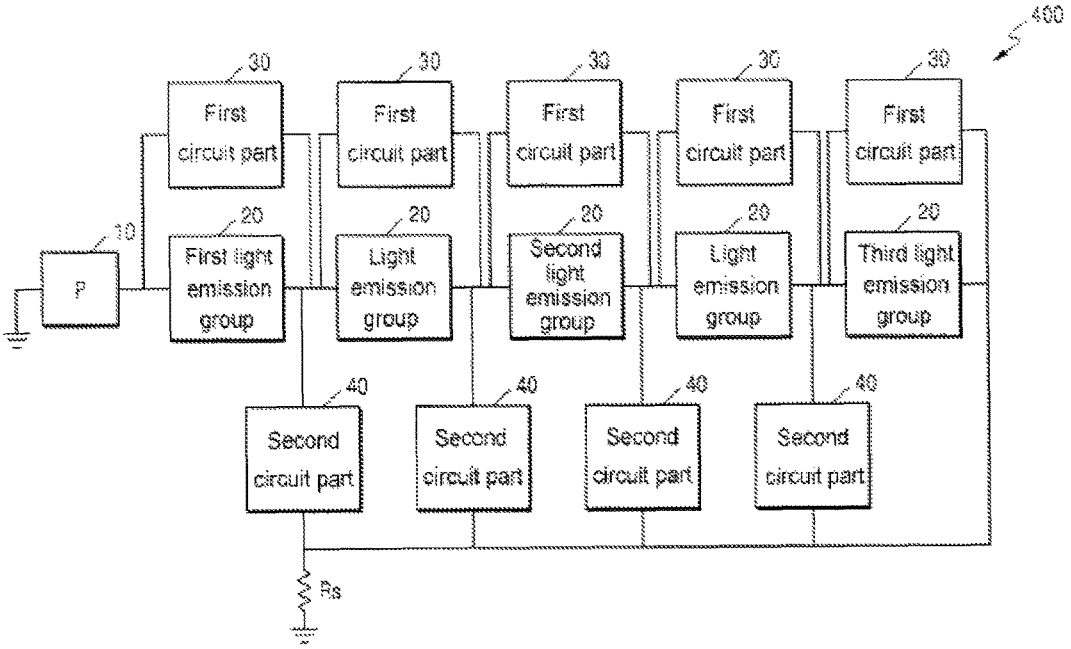
FIG. 11 is a diagram for explaining the structure of an LED lighting device 400 according to a seventh embodiment of the present disclosure.

FIG. 11 is a diagram for explaining the structure of an LED lighting device 400 according to a seventh embodiment of the present disclosure.

The LED lighting device 400 may receive driving power from the AC power supply 10.

The LED lighting device 400 may include a plurality of light emission groups 20. In this case, each of the light emission groups 20 may include at least one LED element 901 and the light emission groups may be connected linearly and electrically so that they have turns from the top upstream side to the bottom upstream side. In this example, the 'top upstream side' represents a location closest to the current output terminal of the power supply part 10 and the 'bottom downstream side' represents a location farthest therefrom.

In addition, the LED lighting device 400 may include a first circuit part 30 that bypasses the connection point between the light emission groups 20.

In addition, the LED lighting device 400 may include a second circuit part 40 that connects the connection point and ground so that AC power supply is first applied to the light emission group located at a downstream side than the light emission group located at a relatively upstream side, among the light emission groups 20 while the potential of the AC power supply 10 supplied rises.

In this case, a reverse-current breaking part may be disposed between the current output terminal of any light emission group 20 and the current output terminal of the first circuit part 30 bypassing the current capable of flowing to any light emission group 20. In this case, the current output from the current output terminal of the first circuit part 30 may not pass through the reverse-current breaking part.

Eighth Embodiment

Figure 12:
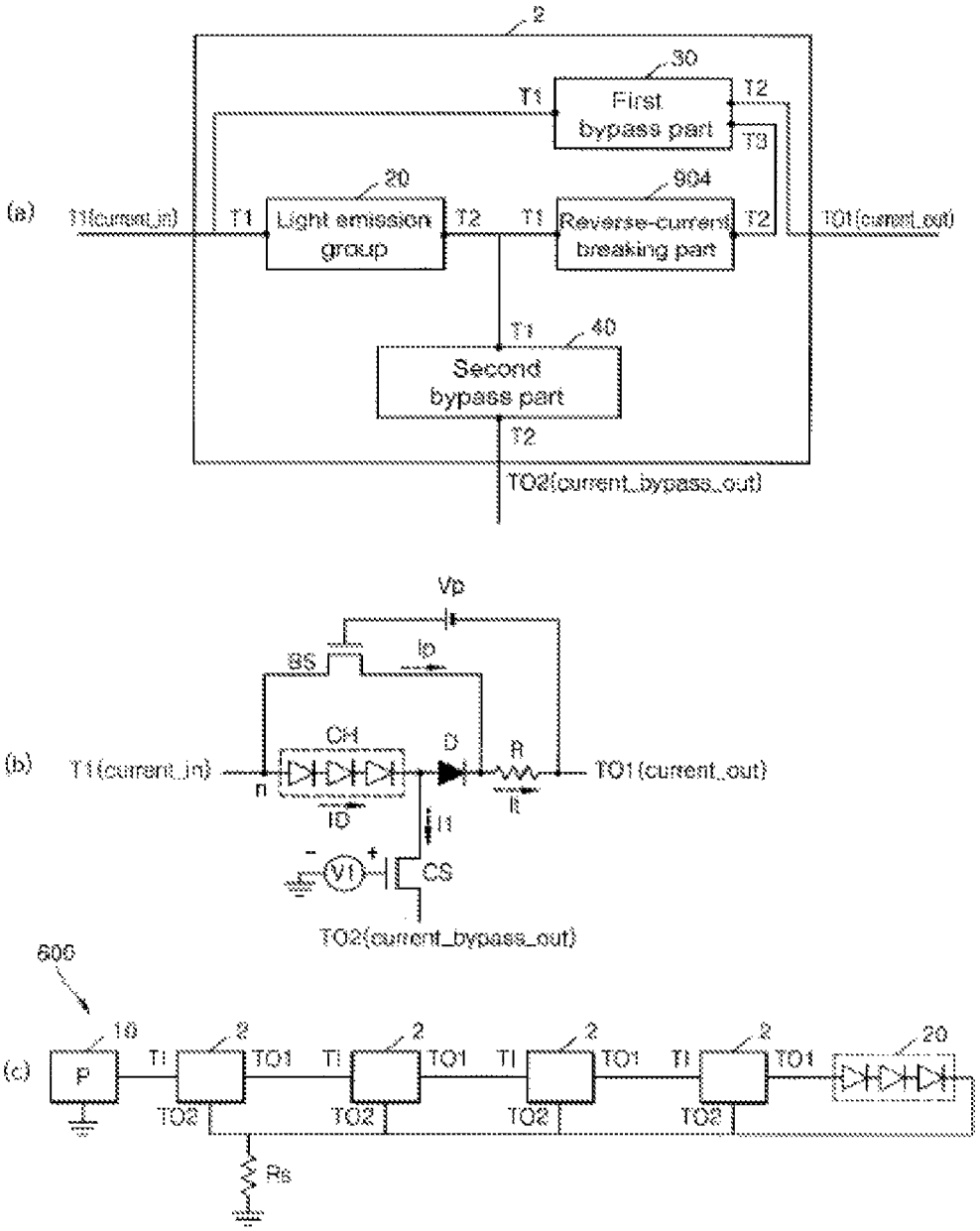
In FIG. 12, (a) to (c) depict an example of a light emission unit configuring the LED lighting device according to an eighth embodiment of the present disclosure.

In FIG. 12, (a) to (c) depicts an example of a light emission unit configuring an LED lighting device according to an eighth embodiment of the present disclosure.

In FIG. 12, (a) is a block diagram of a light emission unit 2 according to an embodiment of the present disclosure. The light emission unit 2 may have three input and output terminals: a current input terminal T1, a current output terminal TO1, and a current bypass output terminal TO2.

In addition, the light emission unit 2 may include a first bypass part 30, a light emission group 20, and a second bypass part 40. In addition, the light emission unit 2 may selectively include the reverse-current breaking part 904.

When the opposite terminals of the first bypass part 30 are connected (i.e., when a current flows through the first bypass part), the opposite terminals of the second bypass part 40 are also connected (i.e., a current flows through the second bypass part). In addition, when the opposite terminals of the first bypass part 30 are open (i.e., when a current does not flow through the first bypass part), the opposite terminals of the second bypass part 40 may also be open (i.e., a current does not flow through the second bypass part).

Thus, when the opposite terminals of the first bypass part 30 are connected, some of the currents input through the current input terminals T1 may be input to the light emission group 20, and the others may be bypassed to a path provided by the first bypass part 30. In addition, some or all of the currents output from the output terminal of the light emission group 20 may not be output to the current output terminal TO1 and may be bypassed through the second bypass part 40 to be output to the current bypass output terminal TO2. In addition, a current passing through a path provided by the first bypass part 30 may be output to the current output terminal TO1.

Alternatively, when the opposite terminals of the first bypass part 30 are open, currents input through the current input terminal T1 are all input to the light emission group 20. In addition, all of the currents output from the output terminal of the light emission group 20 may be output to the current output terminal TO1.

A resistor may be connected to the current bypass output terminal TO2. The resistor may be e.g., the resistor Rs in FIG. 4. According to the value of the resistor and the value of the voltage V input to the distribution switch CS in FIG. 12 (*b*), the value of the current flowing in the distribution switch CS may be determined.

In FIG. 12, (b) represents an implementation of the light emission unit 2 in (a) of FIG. 12. The implementation of the light emission unit 2 by (b) of FIG. 12 is applied to the LED lighting device 1 in FIG. 4.

In FIG. 12, (c) represents an LED lighting device 600 according to an embodiment of the present disclosure that is completed by the connection of the light emission units 2 in (a) of FIG. 12.

The LED lighting device 600 may include one or more light emission units, each of which includes the light emission group 20, the current input terminal T1, the current output terminal TO1, and the current bypass output terminal TO2.

In this case, the current output terminal TO1 may selectively output all or some of the currents input through the current input terminal T1. In addition, when the current output terminal TO1 outputs only some of the currents, the current bypass output terminal TO2 outputs the remainder excluding some of the currents. In addition, the remainder may be currents flowing through the light emission group.

Another light emission group 20 may be connected to the current output terminal TO1 of the light emission unit 2. In this case, the another light emission group 20 may or may not be included in another light emission unit.

In addition, the current bypass output terminal TO2 of the light emission unit 2 may be connected to the current output terminal of the another light emission group 20. In this case, the another light emission group 20 may or may not be included in another light emission unit.

<Lighting Device in which Capacitor is Connected in Parallel with LED in Order to Decrease Flicker>

As could be seen from FIG. 2, a change in brightness of each of light emission groups CH1 to CH4 has two times the frequency of the input voltage Vi. This phenomenon generally appears at the AC power supply direct LED lighting device in FIG. 1 and percent flicker represents 100%.

The lighting devices according to ninth and tenth embodiments of the present disclosure may provide configurations in which a capacitor is connected in parallel with an LED in order to decrease flicker.

Ninth Embodiment

Figure 13:
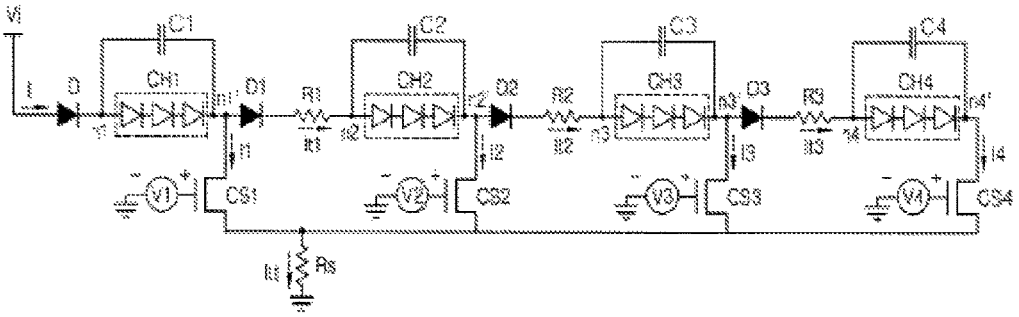
FIG. 13 represents an LED lighting device enabling a current to be always applied to an LED when the LED is driven directly with an AC power supply, according to a ninth embodiment of the present disclosure.

FIG. 13 represents an LED lighting device enabling a current to be always applied to an LED when the LED is driven directly by the AC power supply, according to the ninth embodiment of the present disclosure. Referring to FIG. 13, reverse-current breaking diodes D, and D1 to D3 are connected in series between the light emission groups CH1 to CH4, respectively. In addition, condensers C1 to C4 are connected in parallel to the light emission groups, respectively.

Figure 14:
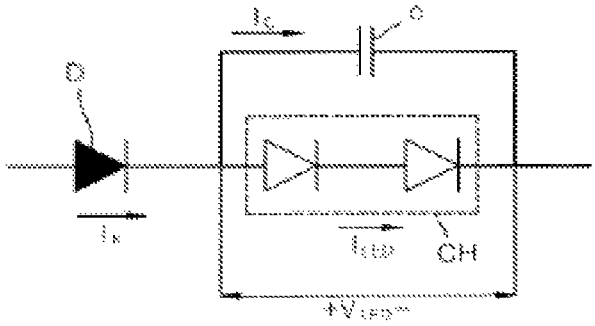
FIG. 14 represents only any one channel part in the circuit FIG. 13, separately.

FIG. 14 represents arbitrary one channel part in the circuit in FIG. 13, separately. FIG. 14 shows when a condenser C is connected in parallel with a light emission group CH corresponding to arbitrary one channel. The reverse-current breaking diode D is connected in series with the light emission group CH and with the condenser C. The light emission group CH may include one or more LEDs.

Figure 15:
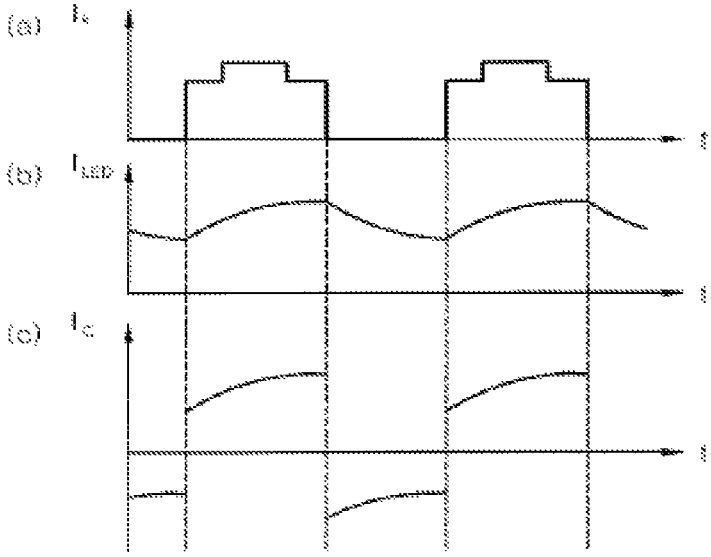
In FIG. 15, (a) represents the waveform of an input current $I_k$ flowing through a reverse-current breaking diode D in FIG. 14, (b) represents the waveform of a light emission current $I_{LED}$ flowing through a light emission group CH, and (c) represents the waveform of a condenser current $I_C$ flowing through a condenser C.

In FIG. 15, (a) represents the waveform of an input current $I_k$ flowing through a reverse-current breaking diode D, (b) represents the waveform of a light emission current $I_{LED}$ flowing through a light emission group CH, and (c) represents the waveform of a condenser current is flowing through a condenser C. The particular shapes of graphs in (b) and (c) of FIG. 15 may depend on the capacity of the condenser C.

When the input current $I_k$ is input through the diode D, the input current $I_k$ is divided and flows into the condenser C and the light emission group CH, the voltage of the condenser increases and thus the light emission current $I_{LED}$ of the light emission group CH also increases.

When the input current $I_k$ is not input, the condenser C is discharged and a current output by the discharging flows into the light emission group CH.

As the capacity of the condenser C increases, a discharging time may be longer. When the discharging time is sufficiently longer than half the cycle of the input power supply (e.g., 1/120 seconds under a 60 Hz power supply), the current flowing through the light emission group CH does not become zero and maintains a value equal to or higher than a certain level. Thus, the light emission group CH may darken over time but is not turned off. As the capacity of the condenser C increases, the current flowing through the light emission group CH is smoother and thus flicker decreases.

It is possible to provide different embodiments by adding the configuration of the condenser in FIG. 13 to the first to eighth embodiments.

Tenth Embodiment

Figure 16:
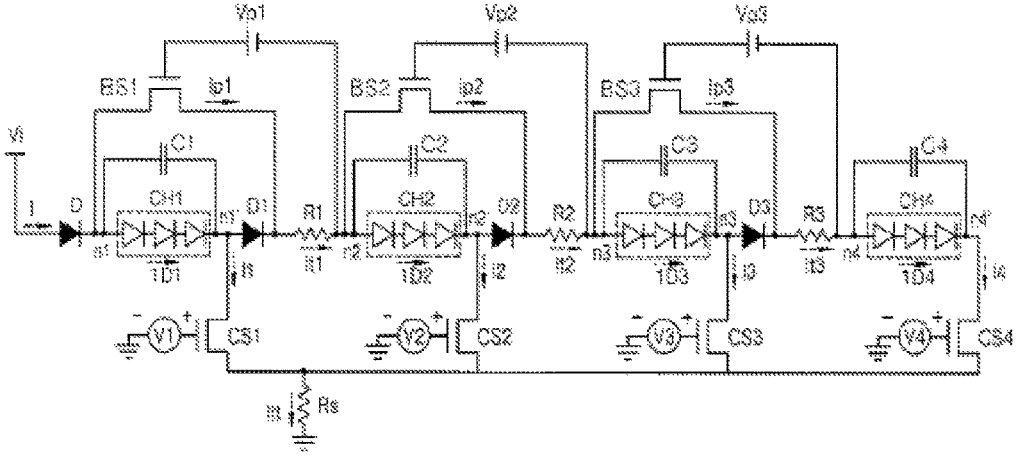
FIG. 16 represents the structure of an LED lighting device according to a tenth embodiment of the present disclosure.

FIG. 16 represents the structure of an LED lighting device according to a tenth embodiment of the present disclosure.

FIG. 16 shows a circuit that is a variation to the second embodiment in FIG. 4. FIG. 16 is different from FIG. 4 in that FIG. 4 provides an example where five light emission groups CH1 to CH5 are connected but FIG. 16 provides an example where four light emission groups CH1 to CH4 are connected. In addition, FIG. 16 is different from FIG. 4 in that a condenser is not connected to each of the light emission groups CH1 to CH5 in FIG. 4 but the condensers C1 to C4 are respectively connected in parallel with the light emission groups CH1 to CH4 in FIG. 16.

It may be easily understood that a current greater than zero may always flow to each of the light emission groups CH1 to CH4 when the condensers C1 to C4 have sufficient capacities, because the condensers C1 to C4 provide energy accumulated therein to the light emission groups CH1 to Ch4, respectively at temporal sections at which an AC power supply may not directly transmit to each of the light emission groups CH1 to CH4 in FIG. 16, by the same principle as that as described in the ninth embodiment.

Like the above-described tenth embodiment, a condenser may also be connected in parallel with the opposite terminals T1 and T2 of the light emission group 20 in (a) of FIG. 12. Also, a condenser may be connected in parallel with the current input terminal and current output terminal of the light emission group CH in (b) of FIG. 12.

<Lighting Device Capable of being Used in Heterogeneous Power Supplies>

When AC power supply supplies having different sizes are applied to one lighting device using an LED in the first to tenth embodiments (or in FIGS. 1 to 16), the bright of the lighting device may vary. For example, the first brightness of the lighting device when the AC power supply has a first value may be different from the second brightness of the lighting device when the AC power supply has a second value greater than the first value. In addition, when a lighting device optimized to an AC power supply having a specific size and designed for a special purpose is connected to an AC power supply having another size, the lighting device may not operate correctly or its efficiency may significantly decrease.

The lighting devices according to eleventh and twelfth embodiments of the present disclosure may provide the configurations of LED lighting devices that may represent uniform light output and efficiency even when AC power supply supplies having different sizes are applied.

Eleventh Embodiment

Figure 17:
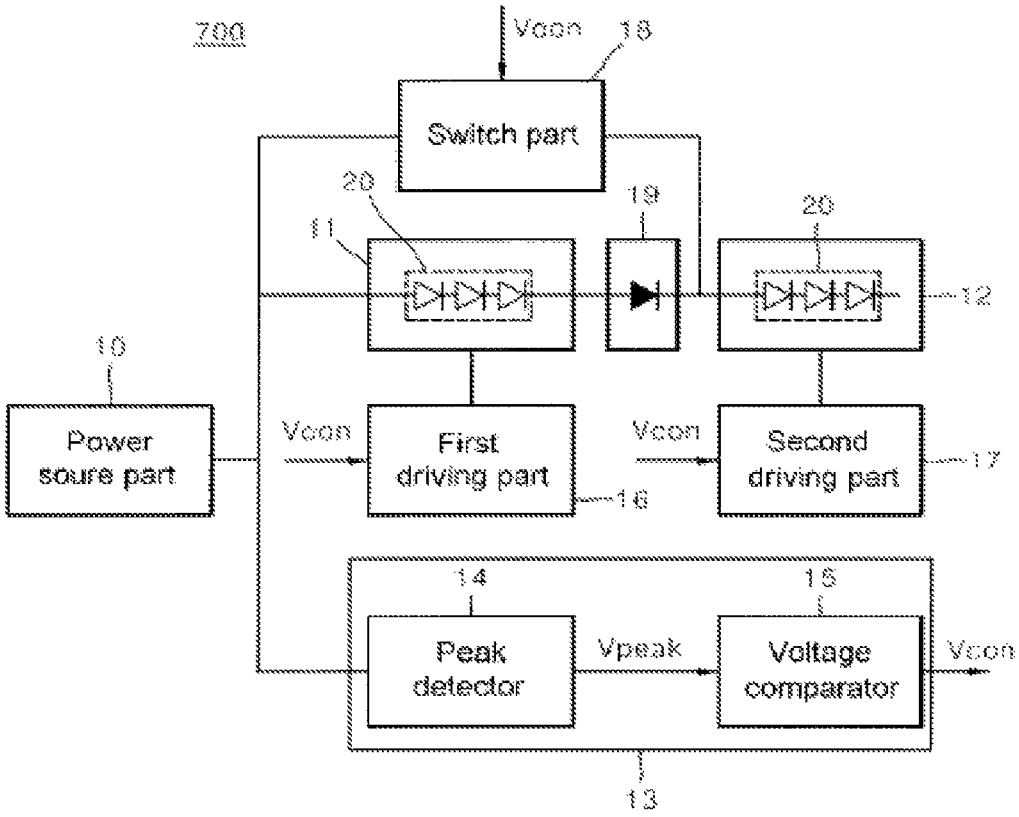
FIG. 17 represents an LED lighting device 700 according to an eleventh embodiment of the present disclosure.

FIG. 17 represents an LED lighting device 700 according to an eleventh embodiment of the present disclosure. Referring to FIG. 17, the LED lighting device 700 may include a power source part 10, LED parts 11 and 12, a control voltage output part 13, driving parts 16 and 17, a switch part 18, and a reverse-current breaking part 19.

The power source part 10 is called a power supply part outputting a waveform repeating increase and decrease over time, and may output a ripple having a cycle of e.g., 100 Hz or 120 Hz. In this case, a peak voltage may be a value of e.g., 120 V*1.414 or 277 V*1.414. In addition, the LED part 11 or 12 may include one or more LED groups 20. In this case, each LED group 20 in the LED part 11 or 12 may be called an individual LED channel or light emission group. For example, when there are N LED groups in one LED part, it may be considered that there are N LED channels in one LED part. The eleventh embodiment of the present disclosure assumes that the LED lighting device 700 includes a first LED part 11 and a second LED part 12. In addition, the LED parts may be called light emission parts.

The control voltage output part 13 may include a peak detector 14 and a voltage comparator 15. The peak detector 14 may hold and output the peak value Vpeak of the output voltage of e.g., the power source part 10. The voltage comparator 15 compares the peak value Vpeak with a preset value and outputs a control voltage Vcon. The control voltage Vcon has a value in a section corresponding to e.g., logical High if the peak value Vpeak is greater than the preset value, and the control voltage has a value in a section corresponding to logical Low if not. Depending on the case, the control voltage may also have a value in a section corresponding to logical Low if the peak value Vpeak is greater than the preset value, and have a value in a section corresponding to logical High if not. The preset value may be provided to the voltage comparator 15 by using a voltage divider R1/R2.

The driving parts 16 and 17 may be connected to the LED parts 11 and 12. The first LED part 11 may be connected to a first driving part 16, and the second LED part 12 may be connected to a second driving part 17.

The first driving part 16 has a characteristic that an ON/OFF state (i.e., enable/disable state) is mutually switched depending on the logic value of the control voltage Vcon.

However, the ON/OFF state of the second driving part 17 is not mutually switched depending on the logic value of the control voltage Won and always maintains the ON state. However, the internal configuration of the second driving part 17 may vary depending on the logic value of the control voltage Vcon.

In the present disclosure, the first LED part 11 and the first driving part 16 may configure a first lighting part. In addition, the second LED part 12 and the second driving part 17 may configure a second lighting part.

When the LED lighting device 700 operates by a commercial power supply having a first voltage (e.g., 120 V), a current flowing in the first LED part 11 may be controlled by the first driving part 16.

However, when the LED lighting device 700 operates by a commercial power supply having a second voltage (e.g., 277 V) higher than the first voltage, the first driving part 16 is disabled and the current flowing in the first LED part 11 may be controlled by the second driving part 17, not by the first driving part 16.

When the LED lighting device 700 operates by a commercial power supply having the first voltage (e.g., 120 V), a current flowing in the second LED part 12 may be controlled by the second driving part 17.

In addition, when the LED lighting device 700 operates by a commercial power supply having the second voltage (e.g., 277 V) higher than the first voltage, the first driving part 16 is disabled and the currents flowing in the first LED part 11 and the second LED part 12 may be controlled by the second driving part 17. In this case, the total light output from the first LED part 11 and the second LED part 12 is determined only by the second driving part 17.

The switch part 18 may connect a first upstream part of the first LED part 11 and a second upstream part of the second LED part 12, and the reverse-current breaking part 19 may connect a first downstream part of the first LED part 11 and the second upstream part of the second LED part 12. The switch part 18 is configured to switch an ON/OFF state according to the logic value of the control voltage Vcon. When the switch part 18 is in an ON state, a current output from the power source part 10 is divided and flows to both the first LED part 11 and the second LED part 12. That is, the first LED part 11 and the second LED part 12 are connected in parallel with each other. On the contrary, when the switch part 18 is in an OFF state, the first LED part 11 and the second LED part 12 are connected in series with each other and a current does not flow through the switch part 18.

Figure 18A:
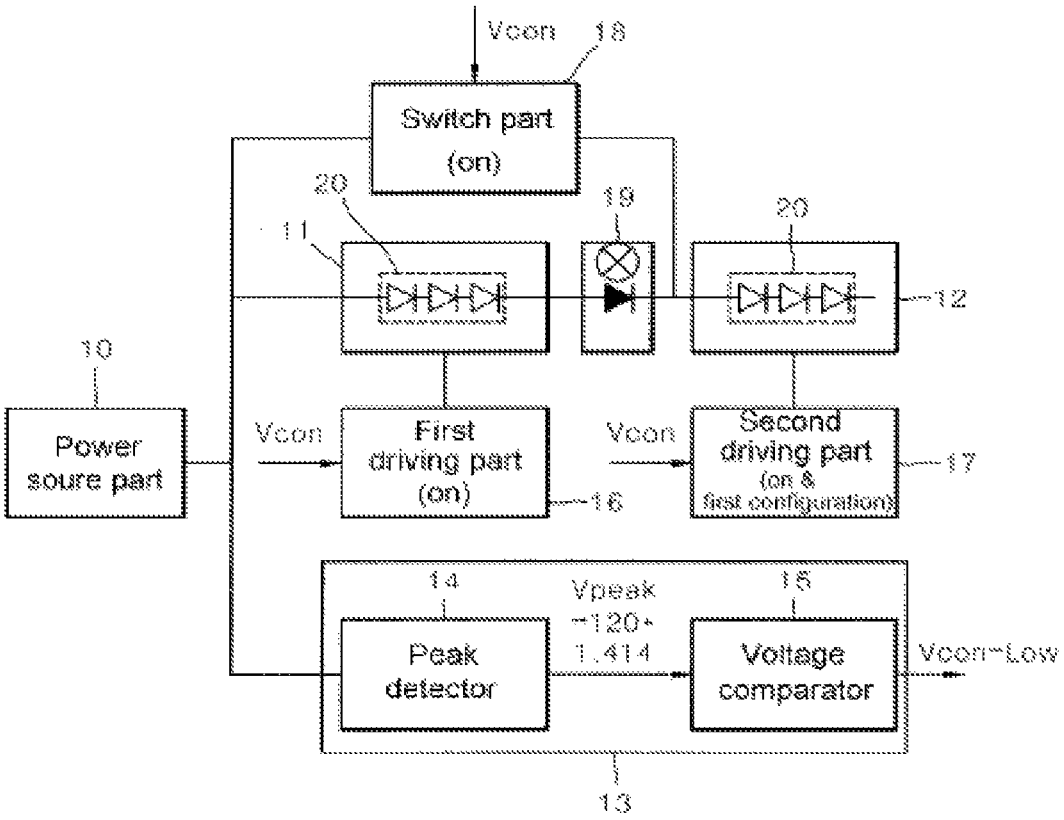
FIG. 18A represents when the LED lighting device 700 in FIG. 17 operates by commercial power having a first voltage (e.g., 120 V).

FIG. 18A represents the operation and circuit configuration connection of the LED lighting device 700 in the case of operating by a commercial power supply having a first voltage (e.g., 120 V). As shown in FIG. 18A, when the voltage of the power source part 10 is the first voltage (e.g., 120 V), the peak detector 14 outputs a voltage peak value of 120*1.414 (=√□2) and the voltage comparator 15 outputs a value in a section corresponding to logical Low as the control voltage Vcon (Vcon=>Low). The control voltage (Vcon=>Low) value of the voltage comparator 15 is input to the first driving part 16, the second driving part 17, and the switch part 18. Thus, the first driving part 16 maintains an ON state and the internal circuit of the second driving part 17 has a first configuration. In addition, the switch part 18 also maintains the ON state. That is, when the control voltage Vcon has a value corresponding to Low, a current path passing through the switch part 18 is formed between the first upstream part and the second upstream part. Also, since the diode of the reverse-current breaking part 19 prevents a current from reversely flowing, the downstream part of the first LED part 11 and the upstream part of the second LED part 12 are shorted and thus the first driving part 16 and the second driving part 17 have a configuration in which they are connected in parallel with each other.

In the case of operating by a commercial power supply having the first voltage (e.g., 120 V), the first driving part 16 is configured to control the value of a current flowing in the first LED part 11. For example, the first driving part 16 may enable the first LED part 11 to have 10 W output power. Also, the second driving part 17 is configured to control the value of a current flowing in the second LED part 12. For example, the second driving part 17 may enable the second LED part 12 to have 10 W output power. To this end, the second driving part 17 has to operate by the first configuration as described above. Accordingly, the first driving part 16 and the second driving part 17 may enable the first LED part 11 and the second LED part 12 to jointly have total 20 W output power.

Figure 18B:
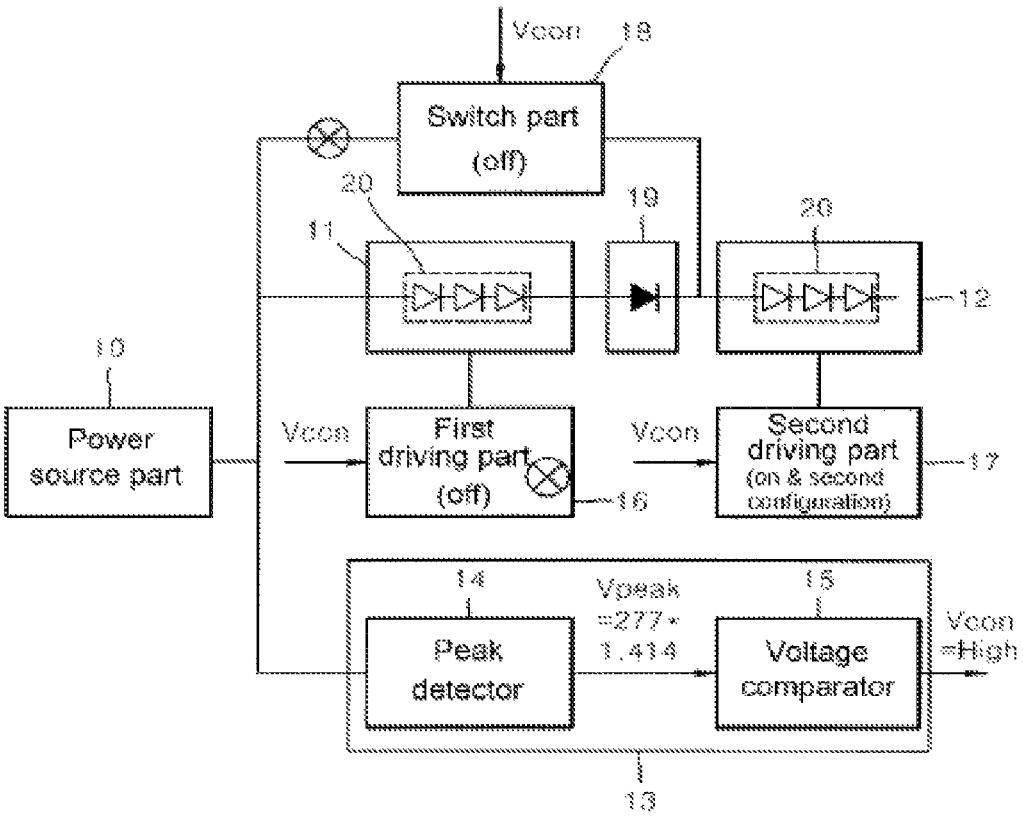
FIG. 18B represents when the LED lighting device 700 in FIG. 17 operates by commercial power having a second voltage (e.g., 277 V) higher than the first voltage.

FIG. 18B represents the operation and circuit configuration connection of the LED lighting device 700 in the case of operating by a commercial power supply having the second voltage (e.g., 277 V). As shown in FIG. 18B, when the voltage of the power source part 10 is the second voltage (e.g., 277 V), the peak detector 14 outputs a voltage peak value of 277*1.414 (=√2) and the voltage comparator 15 outputs a value corresponding to logical High (Vcon=>High). The control voltage (Vcon=>High) value of the voltage comparator 15 is input to the first driving part 16, the second driving part 17, and the switch part 18. Thus, the first driving part 16 becomes an OFF state and the second driving part 17 maintains an ON state and the internal circuit of the second driving part 17 has a second configuration. In addition, the switch part 18 maintains an OFF state. That is, when the control voltage Vcon has a value in a section corresponding to High, the current path between the first upstream part and the second upstream part is blocked. Thus, the first LED part 11 and the second LED part 12 have a configuration in which they are connected in series with each other.

In this case, the second driving part 17 is configured to control the value of a current flowing in the first LED part 11 and the second LED part 12. That is, the second driving part 17 may enable the first LED part 11 and the second LED part 12 to have total 20 W output power. To this end, the second driving part 17 has to operate by the second configuration as described above.

The first and second configurations as described above may mean configurations in which equivalent resistors by sensing resistors Rs2 and Rs3 to be described below have first and second values, respectively.

The LED lighting device may have various configurations according to the series and parallel configurations of the LED parts 11 and 12.

Twelfth Embodiment

Figure 19A:
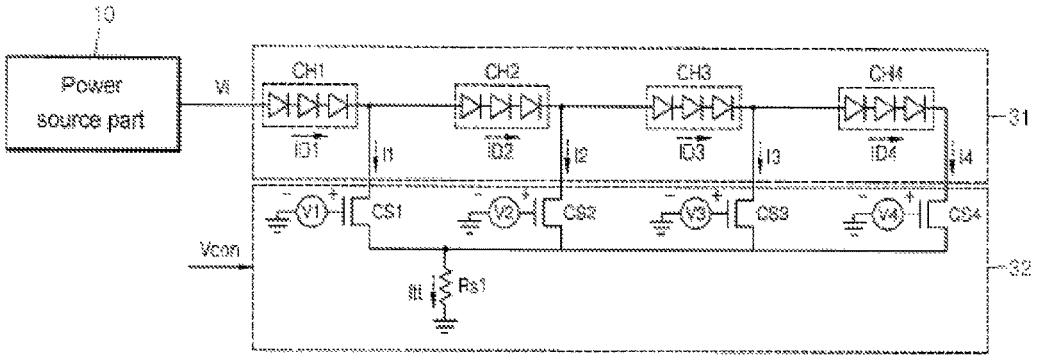
FIGS. 19A and 19B represent examples to which the circuit of the lighting device in FIG. 1 is applied as an LED part and a driving part in FIG. 17.
Figure 19B:
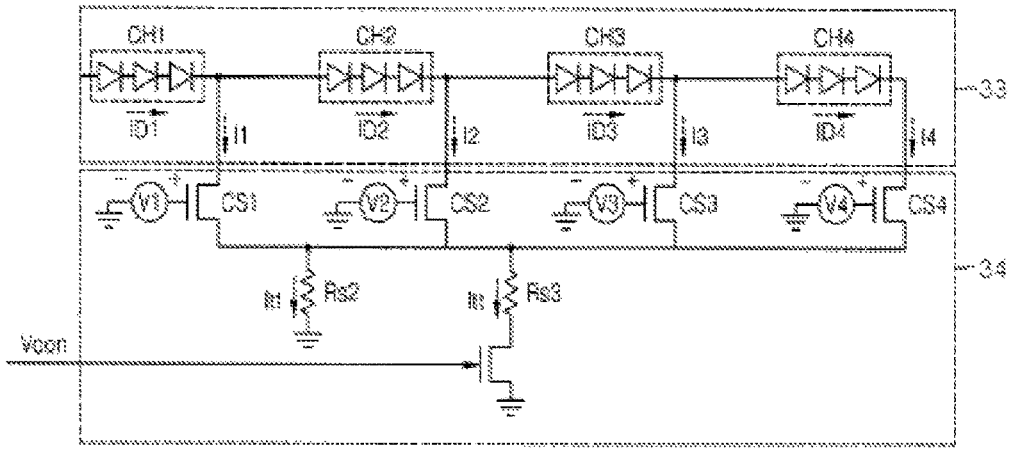

FIGS. 19A and 19B represent examples when the lighting device in FIG. 1 is applied as the LED and the driving part in FIG. 17. A first LED part 31 and a first driving part 32 in FIG. 19A respectively represent examples of the internal structures of the first LED part 11 and the first driving part 16 in FIG. 17, in more detail, and a second LED part 33 and a second driving part 34 in FIG. 19B respectively represent examples of the internal structures of the second LED part 12 and the second driving part 17 in FIG. 17, in more detail.

FIG. 19A represents a circuit in which light emission groups belonging to the first LED part 31 are turned on sequentially from an upstream part to a downstream part with an increase in the voltage of the power source part 10, according to a twelfth embodiment of the present disclosure. FIG. 19B represents a circuit in which light emission groups belonging to the second LED part 33 are turned on sequentially from an upstream part to a downstream part with an increase in the voltage of the power source part 10, according to a twelfth embodiment of the present disclosure.

In the case of operating by a commercial power supply having the first voltage (e.g., 120 V), the first driving part 32 becomes an ON state because a control voltage Vcon having a value in a section corresponding to Low is input to the first driving part 32. In this case, the switch part 18 (not shown) as described in FIG. 17 may connect the first upstream part of the first LED part 31 and the second upstream part of the second LED part 33. In addition, since the switch part receives the control voltage Vcon having a value in a section corresponding to Low and forms a current path passing through the switch part between the first upstream part and the second upstream part, the first LED part 31 and the second LED part 33 have a configuration in which they are connected in parallel with each other. With an increase in the voltage of the power source part 10, the light emission groups CH1 having the same number among the emission groups of the first LED part 31 and the second LED part 33 are simultaneously turned on, after which the next light emission groups CH2 to CH4 are sequentially are turned on. That is, the light emission group CH1 of the first LED part 31 and the light emission group CH1 of the second LED part 33 are simultaneously turned on, after which the light emission groups CH2 of the first LED part 31 and the light emission group CH2 of the second LED part 33 are simultaneously turned on. The light emission groups CH3 and CH4 of the first LED part 31 and the second LED part 33 may also be turned on in the same way.

In the case of operating by a commercial power supply having the second voltage (e.g., 227 V), the first driving part 32 becomes an OFF state because a control voltage Vcon having a value in a section corresponding to High is input to the first driving part 32. In this case, the switch part (not shown) may connect the first upstream part of the first LED part 31 and the second upstream part of the second LED part 33. However, since the switch part receives the control voltage Vcon having a value in a section corresponding to High and blocks a current path passing through the switch part between the first upstream part and the second upstream part, the first LED part 31 and the second LED part 33 have a configuration in which they are connected in series with each other. With an increase in the voltage of the power source part 10, the light emission groups CH1 to CH4 of the first LED part 31 are simultaneously turned and then the light emission groups CH1 to CH4 of the second LED part 33 are sequentially turned on.

Looking into FIG. 19B in detail, the value of a second current flowing through the second LED part 33 is controlled by the second driving part 34, particularly by the value of a sensing resistor in the second driving part 34. In this case, the sensing resistor may mean e.g., an equivalent resistor including Rs2 and Rs3 in the second driving part. In this case, the value of the equivalent resistor may be determined in the following way. When the input voltage has a first value (e.g., 120 V), the control voltage Vcon has a value in a section corresponding to a first logic value (e.g., Low), and when the input voltage has a second value (e.g., 277 V), the control voltage Vcon may have a value in a section corresponding to a second logic value (e.g., High). Since it seems as though the second driving part has no sensing resistor Rs3 when control voltage Vcon has a value in a section corresponding to the first logic value Low, the equivalent resistor implemented by two sensing resistors Rs2 and Rs3 has a first value Rs2. In addition, when the control voltage Vcon has a value in a section corresponding to a second logic value High, the equivalent resistor has a second value Rs2/Rs3 because the sensing resistor Rs2 and the sensing resistor Rs3 are connected in parallel with each other.

When the values of the sensing resistor Rs1 of the first driving part 32 and the sensing resistors Rs2 and Rs3 of the second driving part 34 are appropriately selected, it is possible to adjust the first total light output value of the LED lighting device 700 when the input voltage has the first value (e.g., 120 V) and the second total light output value of the LED lighting device 700 when the input voltage has the second value (e.g., 277 V). It is also possible to adjust the first total light output and the second total light output to be the same.

Another embodiment of the present disclosure may be provided by the combining of the circuit in FIG. 17 with the circuit in FIG. 3 or 4.

That is, it is possible to configure the first LED part 11 in FIG. 17 by using the first circuit part including first elements CHx, Dx, Rx, BSx, and Vpx in FIG. 3 or 4. In addition, it is possible to configure the first driving part 16 in FIG. 17 by using the second circuit part including second elements CSx, Vx, and Rs in FIG. 3 or 4.

Also, it is possible to configure the second LED part 12 in FIG. 17 by using the first circuit part including first elements CHx, Dx, Rx, BSx, and Vpx in FIG. 3 or 4. In addition, it is possible to configure the second driving part 17 in FIG. 17 by using the second circuit part including second elements CSx, Vx, and Rs in FIG. 3 or 4. In this case, in order to provide the second driving part 17, another second sensing resistor may be connected in parallel with the sensing resistor Rs configuring the second circuit part. In this case, the connection of the another second sensing resistor to the sensing resistor Rs may be configured as shown in FIG. 19B.

Another embodiment of the present disclosure may be provided by the combining of the circuit in FIG. 17 with the circuit in (a) of FIG. 12.

That is, it is possible to configure the first LED part 11 in FIG. 17 by using the first circuit part including first function parts 20, 904 and 30 in (a) of FIG. 12. In addition, it is possible to configure the first driving part 16 in FIG. 17 by using the second circuit part including the second function part 40 in (a) of FIG. 12. In this case, the sensing resistor Rs1 as described in FIG. 19A may be connected to the second function part 40.

Also, it is possible to configure the second LED part 12 in FIG. 17 by using the first circuit part including first function parts 20, 904 and 30 in (a) of FIG. 12. In addition, it is possible to configure the second driving part 17 in FIG. 17 by using the second circuit part including the second function part 40 in (a) of FIG. 12. In this case, the sensing resistors Rs2 and Rs3 as described in FIG. 19B may be Connected to the second function part 40.

Another embodiment of the present disclosure may be provided by the combining of the circuit in FIG. 17 with the circuit in FIG. 13.

That is, it is possible to configure the first LED part 11 in FIG. 17 by using the first circuit part including first elements CHx, Dx, Rx, and Cx in FIG. 13. In addition, it is possible to configure the first driving part 16 in FIG. 17 by using the second circuit part including the second elements CSx, Vx, and Rs in FIG. 13.

Also, it is possible to configure the second LED part 12 in FIG. 17 by using the first circuit part including the first elements CHx, Dx, Rx, Cx in FIG. 13. In addition, it is possible to configure the second driving part 17 in FIG. 17 by using the second circuit part including the second elements CSx, Vx, and Rs in FIG. 13. In this case, in order to provide the second driving part 17, another second sensing resistor may be connected in parallel with the sensing resistor Rs configuring the second circuit part. In this case, the connection of the another second sensing resistor to the sensing resistor Rs may be configured as shown in FIG. 19B.

Another embodiment of the present disclosure may be provided by the combining of the circuit in FIG. 17 with the circuit in FIG. 16.

That is, it is possible to configure the first LED part 11 in FIG. 17 by using the first circuit part including first elements CHx, Dx, Rx, Cx, BSx, and Vpx in FIG. 16. In addition, it is possible to configure the first driving part 16 in FIG. 17 by using the second circuit part including the second elements CSx, Vx, and Rs in FIG. 16.

Also, it is possible to configure the second LED part 12 in FIG. 17 by using the first circuit part including the first elements CHx, Dx, Rx, Cx, BSx, and Vpx in FIG. 16. In addition, it is possible to configure the second driving part 17 in FIG. 17 by using the second circuit part including the second elements CSx, Vx, and Rs in FIG. 16. In this case, in order to provide the second driving part 17, another second sensing resistor may be connected in parallel with the sensing resistor Rs configuring the second circuit part. In this case, the connection of the another second sensing resistor to the sensing resistor Rs may be configured as shown in FIG. 19B.

A person skilled in the art may easily implement various changes and modifications by using the above-described embodiments of the present disclosure without departing from the essential characteristic of the present disclosure. Each claim may be combined with any claims that are not dependent thereon, within a scope that may be understood through the present disclosure. Although the LED lighting device using AC power supply have been described with reference to the specific embodiments, they are not limited thereto. Therefore, it will be readily understood by those skilled in the art that various modifications and changes can be made thereto without departing from the spirit and scope of the present invention defined by the appended claims.

The invention claimed is:

1. A light emitting diode (LED) lighting device, comprising:

N-light emitting channels comprising a first light emitting channel, a second light emitting channel, and a third light emitting channel connected in series, wherein the first light emitting channel includes a first upstream part and a first downstream part, the second light emitting channel includes a second upstream part and a second downstream part, and the third light emitting channel includes a third upstream part and a third downstream part, N is a positive integer greater than or equal to 2;

a rectifier configured to rectify an alternating current (AC) power supply from a power source and connected to a start stage of the N-light emitting channels for power supply;

an electric power distribution unit comprising a light emitting channel connection part and a ground connection part;

a reverse-current breaking part configured to couple to the first downstream part of the first light emitting channel and the second upstream part of the second light emitting channel;

a first switch part configured to couple the first upstream part of the first light emitting channel to the second upstream part of the second light emitting channel to form a current path between the first upstream part and the second upstream part; and a second switch part configured to couple the second upstream part of the second light emitting channel to the third upstream part of the third light emitting channel to form a current path between the second upstream part and the third upstream part.

2. The LED lighting device of claim 1, wherein the first switch part comprises a bifurcation at each of connection units at the first light emitting channel and the second light emitting channel.

3. The LED lighting device of claim 1, wherein the first switch part is further configured to form a series connection of the first light emitting channel and the second light emitting channel, in a region in which a forward voltage is equal to or greater than a predetermined voltage when all of the N-light emitting channels are connected in series.

4. The LED lighting device of claim 1, wherein the first switch part is further configured to form a parallel connection of the first light emitting channel and the second light emitting channel, in a region in which a forward voltage is below a predetermined voltage when all the N-light emitting channels are connected in series.

5. The LED lighting device of claim 1, wherein the first switch part is further configured to automatically switch a connection of the first light emitting channel and the second light emitting channel between series and parallel connections based on a peak value of a detected voltage of the AC power supply from the power source.

6. The LED lighting device of claim 1, further comprising a peak detector and a voltage comparator coupled to the peak detector.

7. The LED lighting device of claim 6, wherein the peak detector is configured to hold and output a peak value of an output voltage of the power source, and wherein the voltage comparator is configured to compare the peak value with a preset value and output a control voltage, the control voltage being configured to be supplied to a first driving part coupled to the first light emitting channel and a second driving part coupled to the second light emitting channel.

8. The LED lighting device of claim 7, wherein the first driving part and the second driving part are controlled in such a way that a total light output of the LED lighting device is adjusted to be the same irrespective of an input voltage from the power source.

9. The LED lighting device of claim 7, wherein the control voltage is a value corresponding to a logical low state, the first switch part is configured to enable a current path between the first upstream of the first light emitting channel and the second upstream of the second light emitting channel via the first switch part, such that the first light emitting channel and the second light emitting channel are connected in parallel with each other.

10. The LED lighting device of claim 7, wherein the control voltage is a value corresponding to a logical high state, the first switch part is configured to disable a current path between the first upstream of the first light emitting channel part and the second upstream of the second light emitting channel via the first switch part, such that the first light emitting channel and second light emitting channel are connected in series with each other.

11. The LED lighting device of claim 10, wherein based on an increase in a voltage of the power source, light emission groups of the first light emitting channel are simultaneously turned on and then light emission groups of the second light emitting channel are sequentially turned on.

12. The LED lighting device of claim 7, wherein a value of a current flowing through the second light emitting channel is controlled by one or more sensing resistors of the second driving part coupled to the second light emitting channel.

13. A light emitting diode (LED) driving device for an LED lighting device, comprising:

a power source configured to produce a plurality of different output voltages;

a plurality of light emitting channels comprising a first light emitting channel, a second light emitting channel, and a third light emitting channel connected in series, the plurality of light emitting channels coupled to the power source, the first light emitting channel comprising a first upstream part and a first downstream part, the second light emitting channel comprising a second upstream part and a second downstream part, and the third light emitting channel comprising a third upstream part and a third downstream part;

a reverse-current breaking part configured to couple to the first downstream part of the first light emitting channel and the second upstream part of the second light emitting channel;

a first switch part configured to couple the first upstream part of the first light emitting channel to the second upstream part of the second light emitting channel so as to form a first current path between the first upstream part of the first light emitting channel and the second upstream part of the second light emitting channel;

a second switch part configured to couple the second upstream part of the second light emitting channel to the third upstream part of the third light emitting channel so as to form a second current path between the second upstream part of the second light emitting channel and the third upstream part of the third light emitting channel; and a control voltage output part coupled to the power source and configured to produce a control voltage.

14. The LED driving device of claim 13, wherein each of the first light emitting channel and the second light emitting channel comprises a plurality of light emission groups.

15. The LED driving device of claim 14, wherein based on an increase in the output voltage of the power source, same numbers of light emission groups of the first light emitting channel and the second light emitting channel are simultaneously turned on and after which next light emission groups are sequentially turned on within each of the first light emitting channel and the second light emitting channel.

16. A light emitting diode (LED) driving device for an LED lighting device, comprising:

a power source configured to produce a plurality of different output voltages;

a first light emitting channel and a second light emitting channels both coupled to the power source, the first light emitting channel comprising a first upstream part and a first downstream part, the second light emitting channel comprising a second upstream part and a second downstream part;

a reverse-current breaking part configured to couple to the first downstream part of the first light emitting channel and the second upstream part of the second light emitting channel;

a switch part configured to couple the first upstream part of the first light emitting channel and the second upstream part of the second light emitting channel, via the switch part, such that a current path is established by operation of the switch part between the first upstream part of the first light emitting channel and the second upstream part of the second light emitting channel;

a control voltage output part coupled to the power source and configured to produce a control voltage;

a first driving part configured to drive the first light emitting channel and a second driving part configured to drive the second light emitting channel;

wherein the control voltage output part comprises a peak detector and a voltage comparator, the peak detector being configured to hold and output a peak value of an output voltage of the power source, and the voltage comparator being configured to compare the peak value with a preset value and output the control voltage; and wherein the control voltage is configured to be supplied to the first driving part coupled to the first light emitting channel and the second driving part coupled to the second light emitting channel.

17. The LED driving device of claim 16, wherein the first driving part and the second driving part are controlled in such a way that a total light output of the LED lighting device is adjusted to be substantially the same irrespective of different output voltages from the power source.

18. The LED driving device of claim 16, wherein when the control voltage is a value corresponding to a logical low state, the switch part is configured to enable a current path between the first upstream of the first light emitting channel and the second upstream of the second light emitting channel via the switch part, and the first light emitting channel and the second light emitting channel are connected in parallel with each other.

19. The LED driving device of claim 16, wherein when the control voltage is a value corresponding to a logical high state, the switch part is configured to disable a current path between the first upstream of the first light emitting channel part and the second upstream of the second light emitting channel via the switch part, and the first driving part coupled to the first light emitting channel and the second driving part coupled to the second light emitting channel are connected in series with each other.

20. The LED driving device of claim 16, wherein a value of a current flowing through the second light emitting channel is controlled by one or more sensing resistors of the second driving part coupled to the second light emitting channel.

* * * * *